US007091937B2

(12) United States Patent
Nakamura

(10) Patent No.: US 7,091,937 B2
(45) Date of Patent: Aug. 15, 2006

(54) DISPLAY DEVICE

(75) Inventor: Norio Nakamura, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 332 days.

(21) Appl. No.: 10/233,404

(22) Filed: Sep. 4, 2002

(65) Prior Publication Data

US 2003/0043132 A1 Mar. 6, 2003

(30) Foreign Application Priority Data

Sep. 4, 2001 (JP) ..... 2001-267518
Jan. 31, 2002 (JP) ..... 2002-024729

(51) Int. Cl.
*G09G 3/30* (2006.01)

(52) U.S. Cl. ..... 345/76; 345/77; 345/81

(58) Field of Classification Search ..... 345/76, 345/74.1, 45, 47, 89, 75, 211, 154, 98, 87, 345/94, 77, 81; 313/306, 309; 315/169.1–169.4; 349/110, 129; 341/145; 348/229.1
See application file for complete search history.

(56) References Cited

U.S. PATENT DOCUMENTS 5,191,333 A * 3/1993 Nakano ..... 341/145
5,659,329 A * 8/1997 Yamanobe et al. ..... 345/74.1
5,859,633 A * 1/1999 Kim ..... 345/211
5,982,424 A * 11/1999 Simerly et al. ..... 348/229.1
6,288,494 B1 * 9/2001 Tsukamoto et al. ..... 315/169.1
6,292,157 B1 * 9/2001 Greene et al. ..... 345/1.3
6,323,922 B1 * 11/2001 Suzuki et al. ..... 349/110
6,377,249 B1 * 4/2002 Mumford ..... 345/179
6,538,630 B1 * 3/2003 Tanaka et al. ..... 345/94
6,608,612 B1 * 8/2003 Kokubun et al. ..... 345/98
6,727,877 B1 * 4/2004 Itakura ..... 345/94
6,894,671 B1 * 5/2005 Yamamoto et al. ..... 345/89
2001/0020929 A1 * 9/2001 Nagata et al. ..... 345/98
2002/0033763 A1 * 3/2002 Nakao ..... 341/154
2002/0036604 A1 * 3/2002 Yamazaki et al. ..... 345/76
2002/0126076 A1 * 9/2002 Itakura ..... 345/87
2002/0135553 A1 * 9/2002 Nagai et al. ..... 345/89
2003/0071777 A1 * 4/2003 Kokubun et al. ..... 345/98
2003/0146712 A1 * 8/2003 Inukai ..... 315/169.3
2005/0012698 A1 * 1/2005 Takahashi ..... 345/77
2005/0017931 A1 * 1/2005 Toyoshima et al. ..... 345/76
2005/0219163 A1 * 10/2005 Smith et al. ..... 345/76
2006/0038758 A1 * 2/2006 Routley et al. ..... 345/81
2006/0061526 A1 * 3/2006 Shirasaki et al. ..... 345/77

* cited by examiner

*Primary Examiner*—Bipin Shalwala
*Assistant Examiner*—Prabodh Dharia
(74) *Attorney, Agent, or Firm*—Oblon, Spivak, McClelland, Maier & Neustadt, P.C.

(57) ABSTRACT

A display device includes signal lines, scanning lines, pixel switches, display pixels, and a signal line driving circuit which supplies analog video signals to the signal lines. Each of the display pixels comprises one of three types of luminescent element, the three types of luminescent element being arrayed in a scanning line direction. The driving circuit includes a conversion circuit which is arranged to divide the signal lines into signal line blocks each having a predetermined number of signal lines, converts an external digital signal for each signal line block by means of a digital-to-analog converter into an analog signal based on gradation reference voltage groups corresponding to the type, and serially outputs the analog signal as the analog video signal, and a signal line selection circuit which sequentially distributes the analog video signal to related signal lines of the signal line block.

17 Claims, 17 Drawing Sheets

The number of times suffering influence of potential fluctuation

○ = 0 time
No mark = 1 time
△ = 2 times

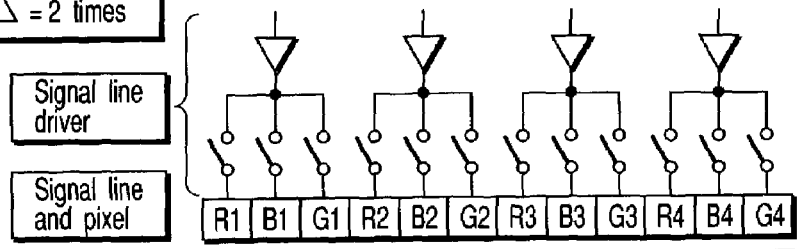

(a) All frames

| | R1 | B1 | G1 | R2 | B2 | G2 | R3 | B3 | G3 | R4 | B4 | G4 |
|---|---|---|---|---|---|---|---|---|---|---|---|---|
| 1st scanning line | 1 | 2 | ○ | △ | 2 | ○ | △ | 2 | ○ | △ | 2 | 3 |
| 2nd scanning line | 1 | 2 | ○ | △ | 2 | ○ | △ | 2 | ○ | △ | 2 | 3 |
| 3rd scanning line | 1 | 2 | ○ | △ | 2 | ○ | △ | 2 | ○ | △ | 2 | 3 |
| 4th scanning line | 1 | 2 | ○ | △ | 2 | ○ | △ | 2 | ○ | △ | 2 | 3 |
| 5th scanning line | 1 | 2 | ○ | △ | 2 | ○ | △ | 2 | ○ | △ | 2 | 3 |

(b)-1 All frames

| | R1 | B1 | G1 | R2 | B2 | G2 | R3 | B3 | G3 | R4 | B4 | G4 |
|---|---|---|---|---|---|---|---|---|---|---|---|---|
| 1st scanning line | 1 | 2 | ○ | ○ | 2 | 1 | 1 | 2 | ○ | ○ | 2 | 1 |
| 2nd scanning line | 1 | 2 | ○ | ○ | 2 | 1 | 1 | 2 | ○ | ○ | 2 | 1 |
| 3rd scanning line | 1 | 2 | ○ | ○ | 2 | 1 | 1 | 2 | ○ | ○ | 2 | 1 |
| 4th scanning line | 1 | 2 | ○ | ○ | 2 | 1 | 1 | 2 | ○ | ○ | 2 | 1 |
| 5th scanning line | 1 | 2 | ○ | ○ | 2 | 1 | 1 | 2 | ○ | ○ | 2 | 1 |

(b)-2 All frames

| | R1 | B1 | G1 | R2 | B2 | G2 | R3 | B3 | G3 | R4 | B4 | G4 |
|---|---|---|---|---|---|---|---|---|---|---|---|---|
| 1st scanning line | ○ | 2 | 1 | 1 | 2 | ○ | ○ | 2 | 1 | 1 | 2 | ○ |
| 2nd scanning line | ○ | 2 | 1 | 1 | 2 | ○ | ○ | 2 | 1 | 1 | 2 | ○ |
| 3rd scanning line | ○ | 2 | 1 | 1 | 2 | ○ | ○ | 2 | 1 | 1 | 2 | ○ |
| 4th scanning line | ○ | 2 | 1 | 1 | 2 | ○ | ○ | 2 | 1 | 1 | 2 | ○ |
| 5th scanning line | ○ | 2 | 1 | 1 | 2 | ○ | ○ | 2 | 1 | 1 | 2 | ○ |

(c)-1 All frames

| | R1 | B1 | G1 | R2 | B2 | G2 | R3 | B3 | G3 | R4 | B4 | G4 |
|---|---|---|---|---|---|---|---|---|---|---|---|---|
| 1st scanning line | 1 | 2 | ○ | ○ | 2 | 1 | 1 | 2 | ○ | ○ | 2 | 1 |
| 2nd scanning line | ○ | 2 | 1 | 1 | 2 | ○ | ○ | 2 | 1 | 1 | 2 | ○ |
| 3rd scanning line | 1 | 2 | ○ | ○ | 2 | 1 | 1 | 2 | ○ | ○ | 2 | 1 |
| 4th scanning line | ○ | 2 | 1 | 1 | 2 | ○ | ○ | 2 | 1 | 1 | 2 | ○ |
| 5th scanning line | 1 | 2 | ○ | ○ | 2 | 1 | 1 | 2 | ○ | ○ | 2 | 1 |

FIG. 8A (c)-2 All frames

| | R1 | B1 | G1 | R2 | B2 | G2 | R3 | B3 | G3 | R4 | B4 | G4 |
|---|---|---|---|---|---|---|---|---|---|---|---|---|
| 1st scanning line | ③ | 2 | 1 | 1 | 2 | ③ | ③ | 2 | 1 | 1 | 2 | ③ |
| 2nd scanning line | 1 | 2 | ③ | ③ | 2 | 1 | 1 | 2 | ③ | ③ | 2 | 1 |
| 3rd scanning line | ③ | 2 | 1 | 1 | 2 | ③ | ③ | 2 | 1 | 1 | 2 | ③ |
| 4th scanning line | 1 | 2 | ③ | ③ | 2 | 1 | 1 | 2 | ③ | ③ | 2 | 1 |
| 5th scanning line | ③ | 2 | 1 | 1 | 2 | ③ | ③ | 2 | 1 | 1 | 2 | ③ |

(d)

| | R1 | B1 | G1 | R2 | B2 | G2 | R3 | B3 | G3 | R4 | B4 | G4 |
|---|---|---|---|---|---|---|---|---|---|---|---|---|
| n-th frame 1st scanning line | 1 | 2 | ③ | ③ | 2 | 1 | 1 | 2 | ③ | ③ | 2 | 1 |
| 2nd scanning line | 1 | 2 | ③ | ③ | 2 | 1 | 1 | 2 | ③ | ③ | 2 | 1 |
| 3rd scanning line | 1 | 2 | ③ | ③ | 2 | 1 | 1 | 2 | ③ | ③ | 2 | 1 |
| 4th scanning line | 1 | 2 | ③ | ③ | 2 | 1 | 1 | 2 | ③ | ③ | 2 | 1 |
| 5th scanning line | 1 | 2 | ③ | ③ | 2 | 1 | 1 | 2 | ③ | ③ | 2 | 1 |

| | R1 | B1 | G1 | R2 | B2 | G2 | R3 | B3 | G3 | R4 | B4 | G4 |
|---|---|---|---|---|---|---|---|---|---|---|---|---|
| (n+1)th frame 1st scanning line | ③ | 2 | 1 | 1 | 2 | ③ | ③ | 2 | 1 | 1 | 2 | ③ |
| 2nd scanning line | ③ | 2 | 1 | 1 | 2 | ③ | ③ | 2 | 1 | 1 | 2 | ③ |
| 3rd scanning line | ③ | 2 | 1 | 1 | 2 | ③ | ③ | 2 | 1 | 1 | 2 | ③ |
| 4th scanning line | ③ | 2 | 1 | 1 | 2 | ③ | ③ | 2 | 1 | 1 | 2 | ③ |
| 5th scanning line | ③ | 2 | 1 | 1 | 2 | ③ | ③ | 2 | 1 | 1 | 2 | ③ |

Returning to driving order of n-th frame (e)

| | R1 | B1 | G1 | R2 | B2 | G2 | R3 | B3 | G3 | R4 | B4 | G4 |
|---|---|---|---|---|---|---|---|---|---|---|---|---|
| n-th frame 1st scanning line | 1 | 2 | ③ | ③ | 2 | 1 | 1 | 2 | ③ | ③ | 2 | 1 |
| 2nd scanning line | ③ | 2 | 1 | 1 | 2 | ③ | ③ | 2 | 1 | 1 | 2 | ③ |
| 3rd scanning line | 1 | 2 | ③ | ③ | 2 | 1 | 1 | 2 | ③ | ③ | 2 | 1 |
| 4th scanning line | ③ | 2 | 1 | 1 | 2 | ③ | ③ | 2 | 1 | 1 | 2 | ③ |
| 5th scanning line | 1 | 2 | ③ | ③ | 2 | 1 | 1 | 2 | ③ | ③ | 2 | 1 |

| | R1 | B1 | G1 | R2 | B2 | G2 | R3 | B3 | G3 | R4 | B4 | G4 |
|---|---|---|---|---|---|---|---|---|---|---|---|---|
| (n+1)th frame 1st scanning line | ③ | 2 | 1 | 1 | 2 | ③ | ③ | 2 | 1 | 1 | 2 | ③ |
| 2nd scanning line | 1 | 2 | ③ | ③ | 2 | 1 | 1 | 2 | ③ | ③ | 2 | 1 |
| 3rd scanning line | ③ | 2 | 1 | 1 | 2 | ③ | ③ | 2 | 1 | 1 | 2 | ③ |
| 4th scanning line | 1 | 2 | ③ | ③ | 2 | 1 | 1 | 2 | ③ | ③ | 2 | 1 |
| 5th scanning line | ③ | 2 | 1 | 1 | 2 | ③ | ③ | 2 | 1 | 1 | 2 | ③ |

Returning to driving order of n-th frame

FIG. 8B

DISPLAY DEVICE

CROSS-REFERENCE TO RELATED APPLICATIONS

This application is based upon and claims the benefit of priority from the prior Japanese Patent Applications No. 2001-267518, filed Sep. 4, 2001; and No. 2002-024729, filed Jan. 31, 2002, the entire contents of both of which are incorporated herein by reference.

BACKGROUND OF THE INVENTION

1. Field of the Invention

The present invention relates to a display device which includes display pixels using luminescent elements of types different in luminous characteristics, particularly to a display device in which organic electro luminescence (EL) elements for emitting light in red, green and blue are used as the luminescent elements.

2. Description of the Related Art

In recent years, organic EL display devices have been regarded as promising monitor displays for portable information terminals since the devices have such characteristics as lightness, thinness, and high luminance. A typical organic EL display device includes a plurality of display pixels arrayed in a matrix form to display an image. In this organic EL display device, a plurality of scanning lines are disposed along rows of the display pixels, a plurality of signal lines are disposed along columns of the display pixels, and a plurality of pixel switches are disposed near intersections of the scanning and signal lines. Each display pixel includes an organic EL element, a driving element connected in series with the organic EL element between a pair of power terminals, and a capacitance element for storing the gate voltage of the driving element. Each pixel switch is turned on in response to a scanning signal from the corresponding scanning line to write or supply an analog video signal from the corresponding signal line to the gate of the driving element. The driving element supplies to the organic EL element a drive current corresponding to the analog video signal.

The organic EL element is of a structure having a luminescent layer formed of a thin film having a red, green, or blue luminescent material such as an organic compound and held between a cathode and anode so that electrons and holes are supplied and recombined in the luminescent layer to produce excitons. The organic EL element outputs light radiated upon deactivation of the excitons. The anode is a transparent electrode formed of ITO or the like, and the cathode is a reflective electrode formed of a metal such as aluminum. With this structure, the organic EL element can produce a luminance of about 100 to 100000 cd/m2 with an applied voltage of just 10 V or less.

In the case where the organic EL display device uses pluralities of display pixels comprising the organic EL elements for emitting light of different colors, for example, red (R), green (G), and blue (B), such luminous characteristics as the luminous efficiency and current-luminance characteristic generally differ between the display pixels for each color. Therefore, if a plurality of display pixels is uniformly driven according to gradation data, the white balance and gradation are distorted.

When the gamma correction is used to solve this problem, the scale of the drive circuitry for the display pixels increases, and it easily becomes difficult to incorporate the circuitry into a portable information terminal.

BRIEF SUMMARY OF THE INVENTION

An object of the present invention is to provide a display device in which display quality can be enhanced without requiring a considerable increase in the scale of the circuitry as a whole.

According to an aspect of the present invention, there is provided a display device comprising: a plurality of signal lines disposed on a substrate; a plurality of scanning lines intersecting the signal lines substantially at right angles; a plurality of pixel switches disposed near the intersections of the signal lines and scanning lines; a plurality of display pixels selectable by the pixel switches; and a signal line driving circuit which supplies analog video signals to the signal lines; wherein each of the display pixels comprises one of two or more types of luminescent element different from each other in the dominant wavelength of light emitted therefrom, the different types of luminescent element are arrayed in a scanning line direction, and the signal line driving circuit includes: a conversion circuit including a plurality of digital-to-analog converters which are arranged such that the signal lines are divided into a plurality of signal line blocks each having a predetermined number of signal lines, convert a digital signal externally input for each signal line block into an analog signal based on a plurality of gradation reference voltage groups corresponding to the types, and serially output the analog signal as the analog video signal; and a signal line selection circuit which sequentially distributes the analog video signal from the conversion circuit to related signal lines of the signal line block.

In the display device, the signal lines are divided into the plurality of signal line blocks each having a predetermined number of signal lines, the digital-to-analog converters convert a digital signal externally input to each signal line block into an analog signal based on a plurality of gradation reference voltage groups corresponding to the types, and the analog signal is serially output as the analog video signal. The signal line selection circuit sequentially distributes the analog video signal from the conversion circuit to related signal lines of the signal line block. In this case, hardware for converting the digital signal to the analog signal can be common to each signal line block. This remarkably reduces the scale of the circuitry of the converting section. Therefore, even if the scale of the gradation reference voltage generating circuitry increases in order to generate a plurality of gradation reference voltage groups, an increase of the scale of the circuitry as a whole is avoided. Moreover, individual gamma correction for different types of luminescent elements can be carried out in the conversion. Therefore, the display quality can be enhanced without requiring a considerable increase in the scale of the circuitry as a whole.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIGS. 8A and 8B are explanatory views showing a relationship between the number of times the potentials of the signal lines for red, green, and blue pixels fluctuate and the driving order of the signal lines;

DETAILED DESCRIPTION OF THE INVENTION

An organic EL display device according to a first embodiment of the present invention will be described hereinafter with reference to the accompanying drawings. The organic EL display device includes an organic EL panel and an external circuit for driving the organic EL panel.

Figure 1:
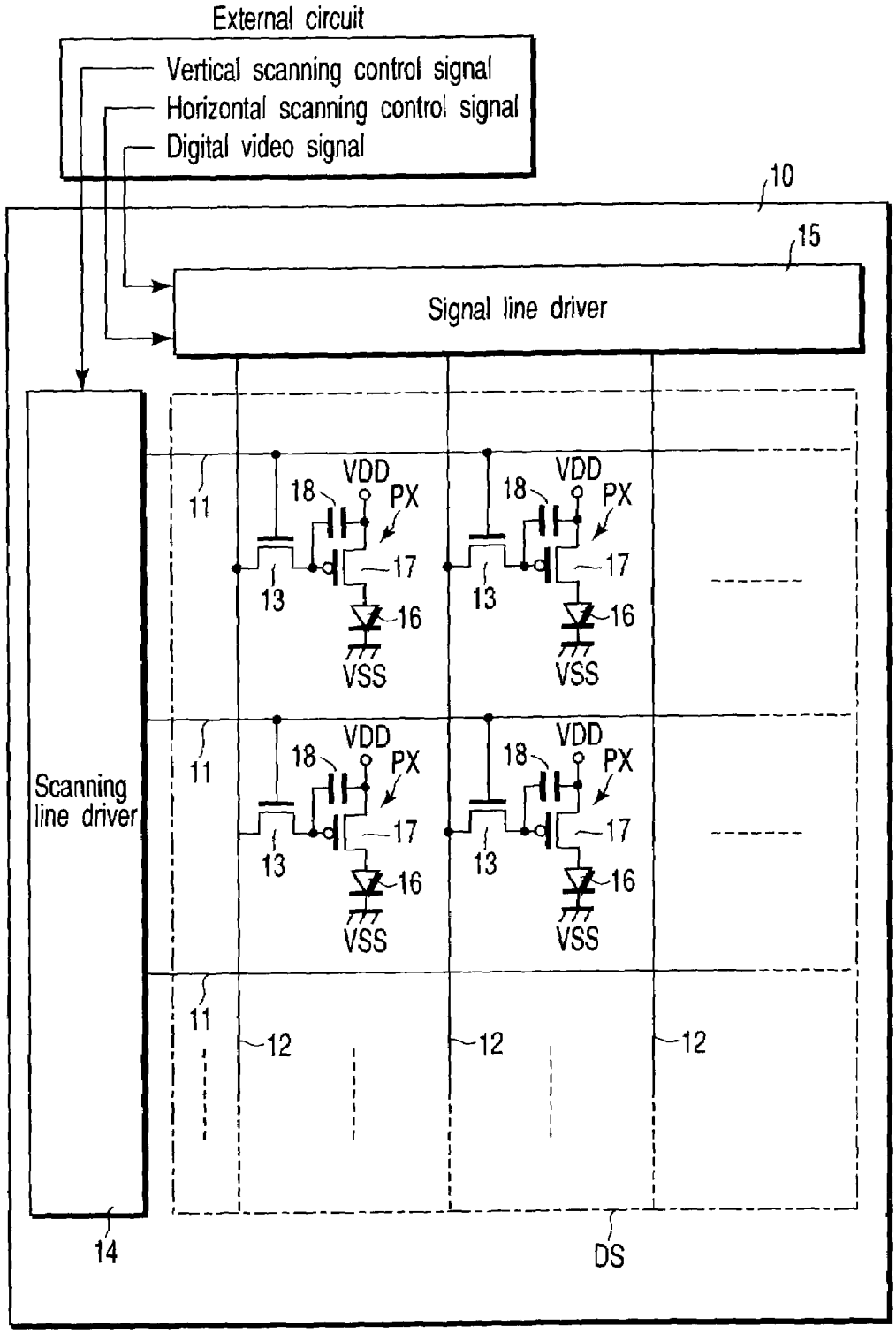
FIG. 1 is a circuit diagram schematically showing the configuration of an organic EL display device according to a first embodiment of the present invention.

FIG. 1 shows the configuration of the organic EL panel 10. The organic EL panel 10 includes a plurality of display pixels PX arrayed substantially in the matrix form on an insulating substrate such as glass so as to form a display section DS; a plurality of scanning lines 11 disposed along rows of the display pixels PX; a plurality of signal lines 12 disposed along columns of the display pixels PX; a plurality of pixel switches 13 disposed near intersections of the scanning lines 11 and signal lines 12; a scanning line driver 14 which is disposed outside the display section DS and drives the scanning lines 11; and a signal line driver 15 which is disposed outside the display section DS and drives the signal lines 12. Each of the display pixels PX includes: an organic EL element 16 for emitting light in one of colors of red (R), green (G), and blue (B); a driving element 17 connected in series with the organic EL element 16 between a pair of power terminals VDD, VSS and formed, for example, of a P-channel thin-film transistor; and a capacitance element 18 for storing the gate voltage of the driving element 17. The power terminals VDD and VSS are set to potentials of, for example, +12.5 V and 0 V by external power source voltages. In each row of the display pixels PX, three types of organic EL element 16 for emitting light in red (R), green (G), and blue (B) are regularly arranged in a fixed order. The luminous characteristics, such as the luminous efficiency and current-luminance characteristic, of each organic EL elements 16 depends on the luminous color.

Each pixel switch 13 is formed, for example, of an N-channel thin-film transistor and is controlled by a scanning signal supplied from a corresponding scanning line 11 to write or supply an analog video signal from a corresponding signal line 12 to the gate of the driving element 17 and the capacitance element 18. The driving element 17 supplies to the organic EL element 16 a drive current Id corresponding to the analog video signal. The organic EL element 16 is of a structure having a luminescent layer formed of a thin film having a red, green, or blue fluorescent organic compound and held between a cathode and anode so that electrons and holes are supplied and recombined in the luminescent layer to produce excitons. The organic EL element provides light radiated upon deactivation of the excitons. Here, the N-channel thin-film transistor for the pixel switch 13 and the P-channel thin-film transistor for the driving element 17 are formed using a semiconductor layer such as a polycrystalline silicon film. Moreover, the scanning line driver 14 and signal line driver 15 include N- and P-channel thin-film transistors formed using a polycrystalline silicon film in the same manufacturing process as that of the pixel switches 13 and driving element 17, and integrally formed on the same insulating substrate.

The scanning line driver 14 receives a vertical scanning control signal from the external circuit, and sequentially supplies a scanning signal to the scanning lines 11 in one frame period (1F) by the control of the vertical scanning control signal. That is, the scanning signal is supplied to a different one of the scanning lines 11 for each horizontal writing period, and each of the pixel switches 13 is driven by the scanning signal from a corresponding scanning line 11. The signal line driver 15 receives a horizontal scanning control signal and digital video signal from the external circuit, sequentially converts gradation data DATA of the digital video signal to a gradation voltage in each horizontal scanning period by the control of the horizontal scanning control signal, and outputs these gradation voltages as analog video signals to the signal lines 12.

The pixel switches 13 of each row are made conductive by the scanning signal supplied from the corresponding scanning line 11 for one horizontal writing period, and kept non-conductive until the scanning signal is supplied again after the elapse of one frame period (1F) corresponding to the update cycle of the video signal. The driving element 17 supplies the drive current Id corresponding to the analog video signal supplied via the pixel switches 13 and stored in the capacitance element 18 to the organic EL element 16. This analog video signal is maintained for a predetermined period after being stored in the capacitance element 18, and updated for each frame period.

Figure 2:
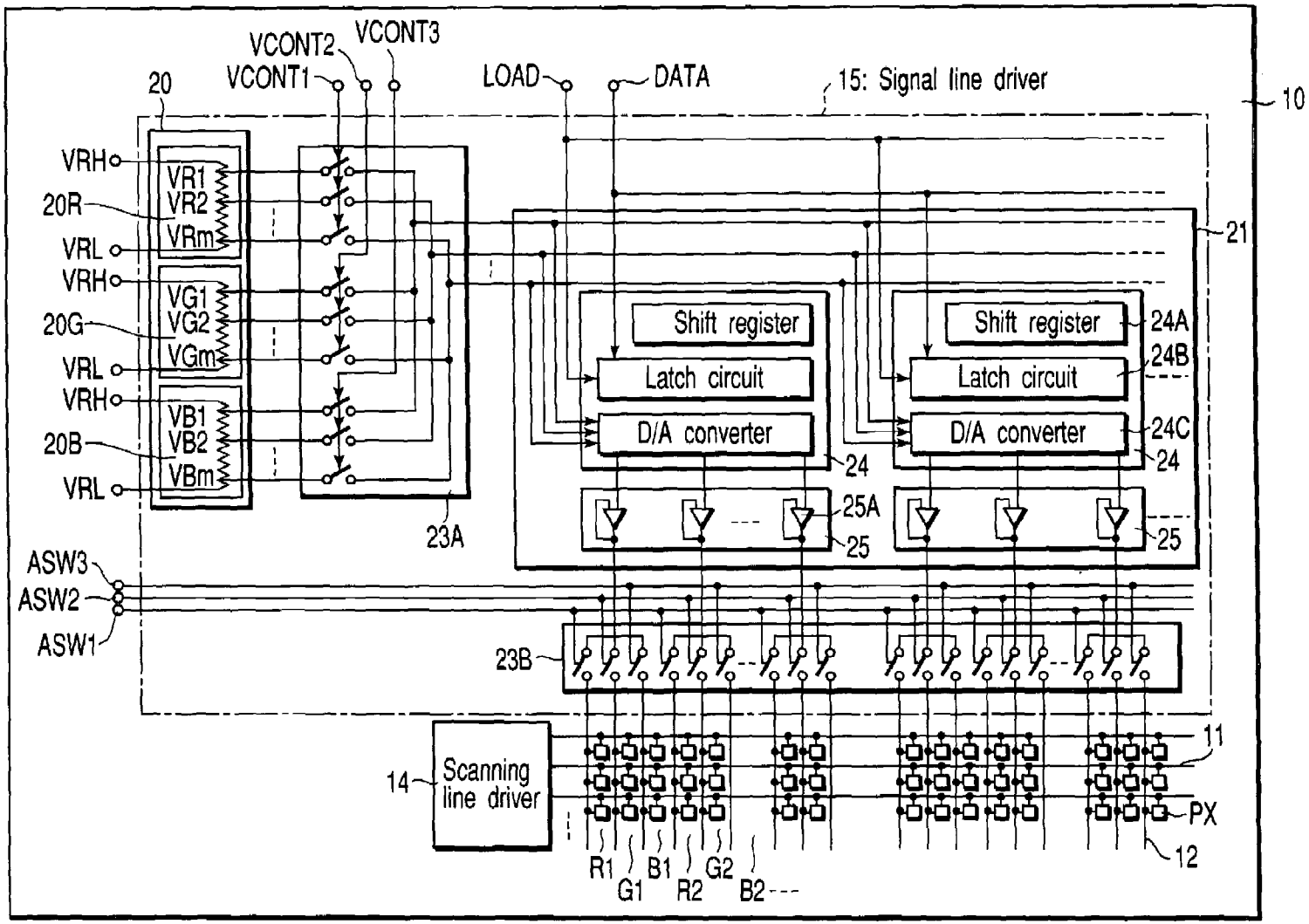
FIG. 2 is a circuit diagram showing the configuration of a signal line driver shown in FIG. 1.

FIG. 2 shows the configuration of the signal line driver 15 in detail. The signal line driver 15 is configured to drive each of the sub-arrays obtained by dividing the array of the display pixels PX in a row direction. More specifically, the signal line driver 15 includes a reference voltage generating section 20 for generating three gradation reference voltage groups VR1 to VRm, VG1 to VGm, and VB1 to VBm assigned to the luminous characteristics of three types of organic EL element 16, a conversion and output section 21 for converting items of digital gradation data DATA supplied with respect to a predetermined number of display pixels PX forming one sub-array into analog video signals and outputting the analog video signals for the display pixels PX, a reference voltage group changing circuit 23A for selecting each of three gradation reference voltage groups VR1 to VRm, VG1 to VGm, and VB1 to VBm generated by the reference voltage generating section 20 at different predetermined timings, and a signal line changing circuit 23B for outputting the analog video signals to related signal lines 12.

The analog video signals output from the signal line driver 15 are supplied to the display pixels PX of the row specified by the scanning signal output from the scanning line driver 14.

The reference voltage generating section 20 includes voltage generators 20R, 20G, 20B for generating the gradation reference voltage groups VR1 to VRm, VG1 to VGm, and VB1 to VBm for red, green and blue. The voltage generator 20R is a voltage dividing circuit for dividing a power source voltage for red supplied between reference power terminals VRL and VRH by means of resistors to generate the gradation reference voltage group for red, that is, m reference voltages VR1 to VRm. The voltage generator 20G is a voltage dividing circuit for dividing a power source voltage for green supplied between reference power terminals VGL and VGH by means of resistors to generate the gradation reference voltage group for green, that is, m reference voltages VG1 to VGm. The reference voltage generator 20B is a voltage dividing circuit for dividing a power source voltage for blue supplied between reference power terminals VBL and VBH by means of resistors to generate the gradation reference voltage group for blue, that is, m reference voltages VB1 to VBm. Here, the reference voltages of the gradation reference voltage groups for red, green and blue are properly determined to perform gamma correction to eliminate the distorted white balance and gradation between the organic EL elements 16.

The reference voltage group changing circuit 23A changes the selection of the gradation reference voltage groups for red, green, and blue from the voltage generators 20R, 20G, 20B based on changing control signals VCONT1, VCONT2, and VCONT3 being selectively set to high level. The reference voltage group changing circuit 23A includes m switches for selecting the reference voltages VR1 to VRm when the changing control signal VCONT1 is at high level, m switches for selecting the reference voltages VG1 to VGm when the changing control signal VCONT2 is at high level, and m switches for selecting the reference voltages VB1 to VBm when the changing control signal VCONT3 is at high level. Each of the gradation reference voltage groups for red, green, and blue is supplied from the reference voltage group changing circuit 23A via m reference voltage signal lines to the conversion and output section 21. Moreover, the changing control signals are controlled so that the reference voltages corresponding to the respective RGB colors are sequentially output in the horizontal scanning period.

The conversion and output section 21 includes a plurality of conversion circuits 24 which are assigned to the sub-arrays and operate independently of one another, and a plurality of output circuits 25 connected to the conversion circuits 24, respectively. Each of the conversion circuits 24 includes a shift register 24A for sequentially shifting the horizontal scanning control signal to subsequent stages, a latch circuit 24B for sequentially latching the gradation data DATA in response to each of the outputs from the stages of the shift register 24A so that the gradation data DATA is converted from serial form to parallel form, and a digital-to-analog converter 24C for converting the gradation data DATA output from the latch circuit 24B in parallel under control of a load signal LOAD to an analog gradation voltage. The digital-to-analog converter 24C is formed of digital-to-analog converter (DAC) modules for the predetermined number of outputs. For example, when the gradation data DATA for the red display pixels PX is supplied, the digital-to-analog converter 24C refers to the gradation reference voltage group for red selected by the reference voltage group changing circuit 23A to convert the gradation data DATA to the analog form. Similarly, when the gradation data DATA for the green display pixels PX is supplied, the digital-to-analog converter 24C refers to the gradation reference voltage group for green selected by the reference voltage group changing circuit 23A to convert the gradation data DATA to analog form. Furthermore, similarly, when the gradation data DATA for the blue display pixels PX is supplied, the digital-to-analog converter 24C refers to the gradation reference voltage group for blue selected by the reference voltage group changing circuit 23A to convert the gradation data DATA to analog form. In each output circuit 25, output amplifiers 25A are disposed for the DAC modules to amplify the gradation voltages from the digital-to-analog converter 24C in a predetermined ratio and output the gradation voltages for the display pixels of a corresponding sub-array as analog video signals.

Further, the signal line changing circuit 23B distributes the analog video signal from each output amplifier 25A of the output circuit 25 to the related signal lines 12. More specifically, switch circuits are disposed for the DAC modules and connected to signal line blocks, each of which includes a predetermined number of signal lines 12, such as 3×n (n=1, 2, 3, . . . ) signal lines 12 for the RGB colors of the display pixels PX. Each switch circuit selects the predetermined number of signal lines 12 at different predetermined timings to sequentially distribute the analog video signals. In this embodiment, each switch circuit is connected to three adjacent signal lines 12 forming one signal line block. Moreover, each switch circuit is formed of switches the number of which equals that of the signal lines of the corresponding signal line block. The switches of each switch circuit are controlled by changing control signals ASW1, ASW2, and ASW3, and change the three adjacent signal lines 12 with respect to the corresponding output amplifier 25A. That is, here the signal line changing circuit 23B includes: <total number of signal lines/number of signal lines per signal line block> switches which select the signal lines 12 for the red pixels with respect to the output amplifiers 25A of the output circuits 25 when the changing control signal ASW1 is at high level; <total number of signal lines/number of signal lines per signal line block> switches which select the signal lines 12 for the green pixels with respect to the output amplifiers 25A of the output circuits 25 when the changing control signal ASW2 is at high level; and (total signal line number/signal line number in one signal line block) switches which select the signal lines 12 for the blue pixels with respect to the output amplifiers 25A of the output circuits 25 when the changing control signal ASW3 is at high level.

Figure 3:
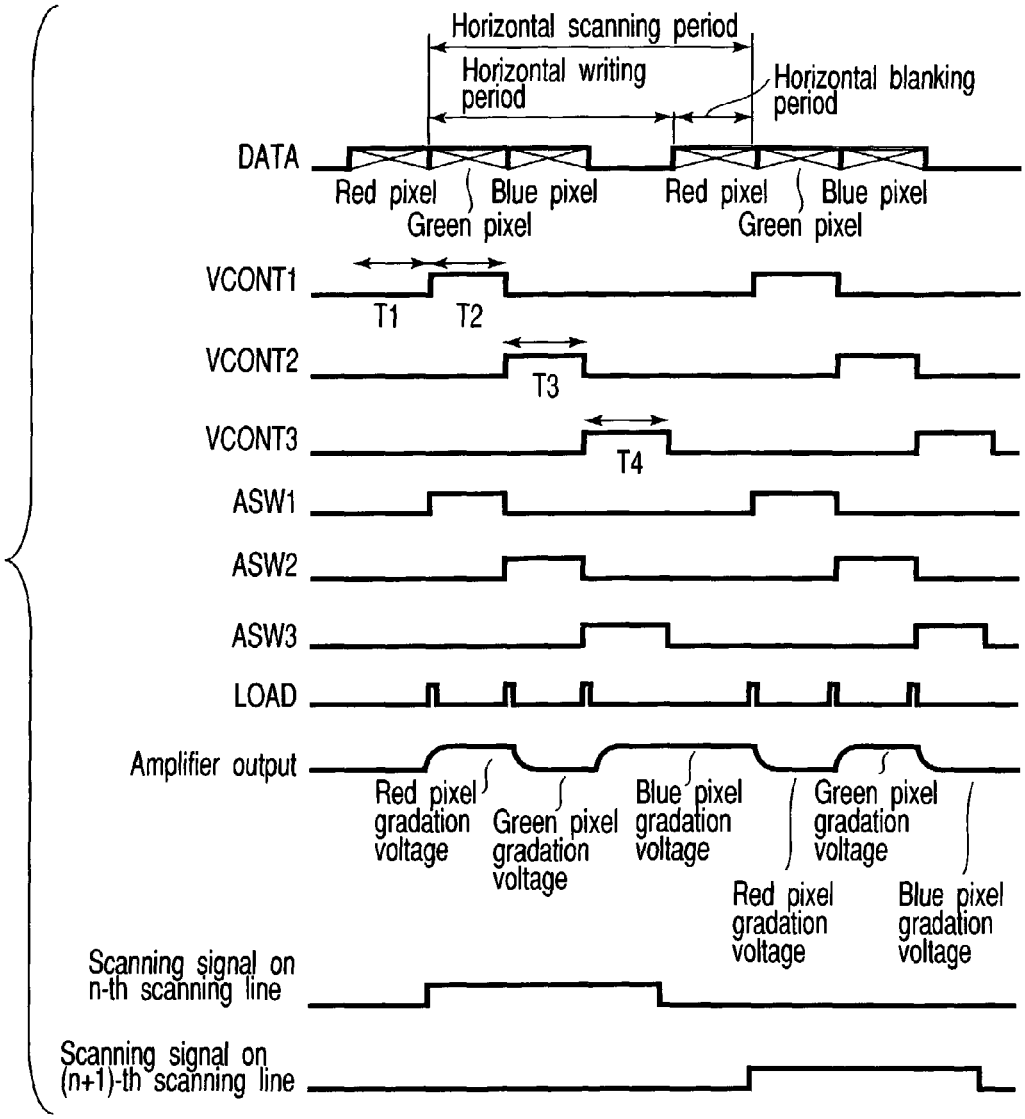
FIG. 3 is a timing chart showing the operation of the signal line driver shown in FIG. 2.

FIG. 3 shows the operation of the organic EL display device. In the organic EL display device, the gradation data DATA for the red, green, and blue pixels of each row is sequentially supplied as digital video signals. Concretely, the gradation data DATA for the red, green, and blue pixels of each row is supplied in periods T1, T2, and T3, respectively. In each of the conversion circuits 24, the latch circuit 24B sequentially latches the gradation data DATA for the red pixels in the period T1, and supplies the data to the digital-to-analog converter 24C in response to the load signal LOAD in the period T2. The changing control signals VCONT1 and ASW1 are kept at high level in the period T2. Thereby, the digital-to-analog converter 24C refers to the gradation reference voltage group VR1 to VRm from the voltage generator 20R to convert the gradation data DATA for the red pixels to analog gradation voltages, and supplies the voltages in parallel to the output amplifiers 25A for one signal line block. These gradation voltages are amplified by the output amplifiers 25A, and supplied as analog video signals to the signal lines 12 for the red pixels in the signal line block. Furthermore, the latch circuit 24B sequentially latches the gradation data DATA for the green pixels in the period T2, and supplies the data to the digital-to-analog converter 24C in response to the load signal LOAD in the period T3. The changing control signals VCONT2 and ASW2 are kept at high level in the period T3. Thereby, the digital-to-analog converter 24C refers to the gradation reference voltage group VG1 to VGm from the voltage generator 20G to convert the gradation data DATA for green pixels to analog gradation voltages, and supplies the voltages in parallel to the output amplifiers 25A. These gradation voltages are amplified by the output amplifiers 25A, and supplied as analog video signals to the signal lines 12 for the green pixels in the signal line block. Additionally, the latch circuit 24B sequentially latches the gradation data DATA for the blue pixels in the period T3, and supplies the data to the digital-to-analog converter 24C in response to the load signal LOAD in the period T4. The changing control signals VCONT3 and ASW3 are kept at the level in the period T4. Thereby, the digital-to-analog converter 24C refers to the gradation reference voltage group VB1 to VBm from the voltage generator 20B to convert the gradation data DATA for the blue pixels to analog gradation voltages, and supplies the voltages in parallel to the output amplifiers 25A. These gradation voltages are amplified by the output amplifiers 25A, and supplied as analog video signals to the signal lines 12 for the blue pixels in the signal line block.

In the organic EL display device according to the above-described embodiment, the signal lines to be driven are changed in units of color in each signal line block, and the gradation reference voltage group is also changed upon a change in the signal lines to be driven. Therefore, common hardware for converting the gradation data to gradation voltages can be used for each signal line block. Thereby, the scale of the circuitry of the conversion and output section 21 is reduced remarkably. Even when the scale of the gradation reference voltage generating section 20 increases to generate a plurality of gradation reference voltage groups, increase in the scale of the circuitry as a whole can be avoided. Moreover, the gradation data is converted to the gradation voltages with reference to three gradation reference voltage groups assigned to the luminous characteristics of the red, green, and blue organic EL elements 16. Therefore, the distortion of the RGB white balance and gradation can be eliminated by individual gamma correction performed with respect to the different luminous characteristics in the conversion. Accordingly, the display quality can be enhanced without requiring an increase in the scale of the circuitry as a whole.

Figure 4:
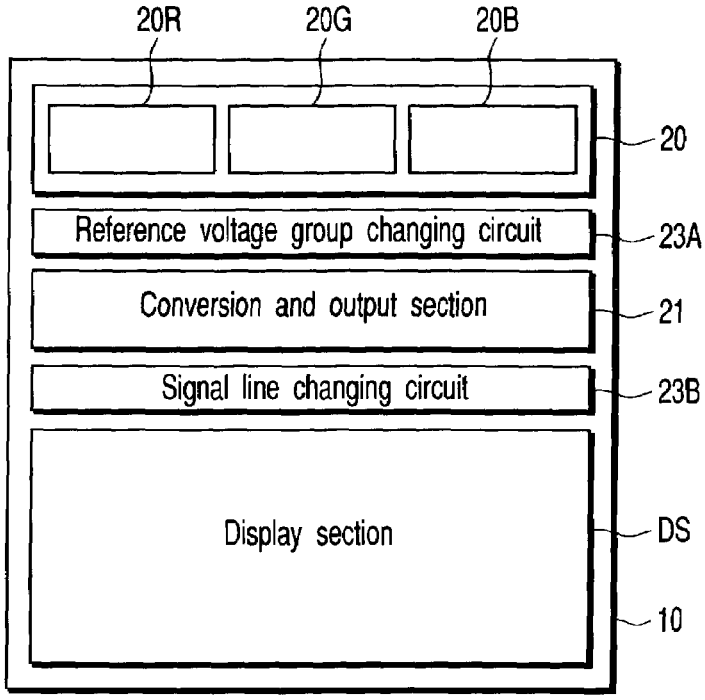
FIG. 4 is a diagram showing a display panel including a reference voltage generating section, reference voltage group changing circuit, conversion and output section, signal line changing circuit, and display section shown in FIG. 2.
Figure 5:
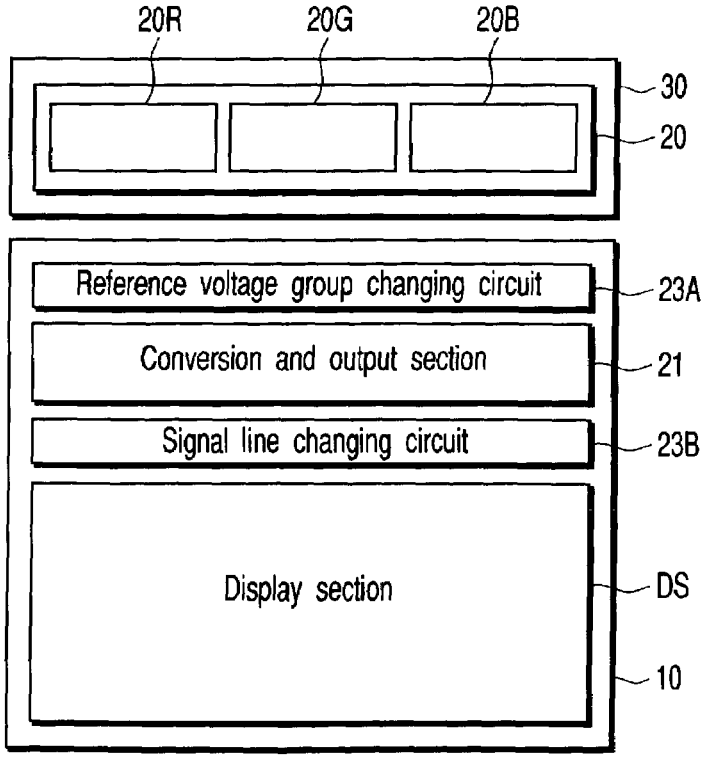
FIG. 5 is a diagram showing a driving circuit board including the reference voltage generating section shown in FIG. 2, together with a display panel including the reference voltage group changing circuit, conversion and output section, signal line changing circuit, and display section.
Figure 6:
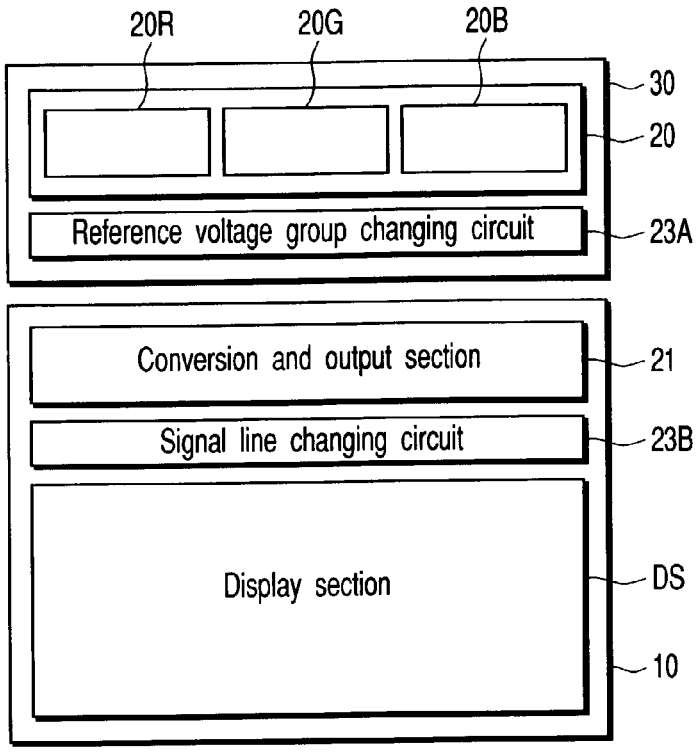
FIG. 6 is a diagram showing a driving circuit board including the reference voltage generating section and reference voltage group changing circuit shown in FIG. 2, together with a display panel including the conversion and output section and signal line changing circuit.
Figure 7:
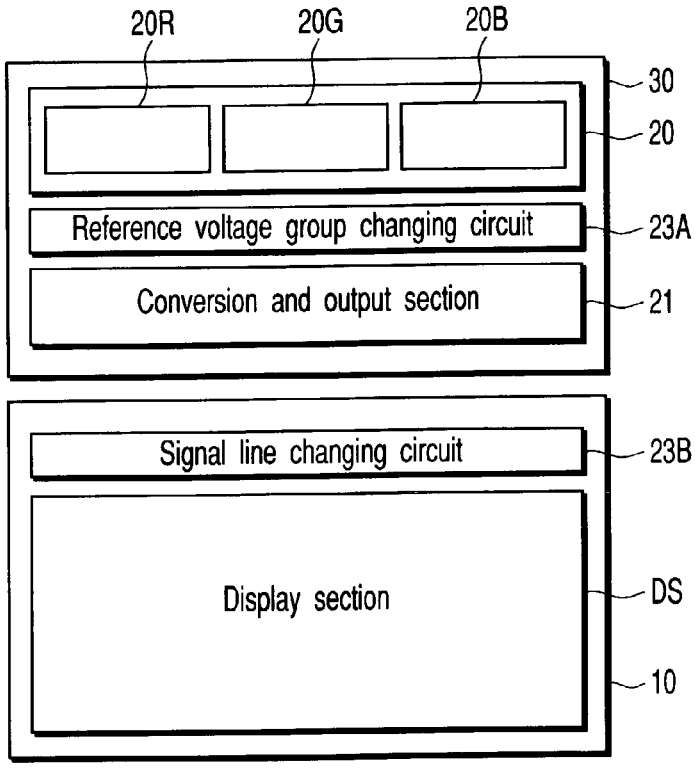
FIG. 7 is a diagram showing the driving circuit board including the reference voltage generating section, reference voltage group changing circuit, and conversion and output section shown in FIG. 2, together with a display panel including the signal line changing circuit.

Additionally, in the embodiment, as shown in FIG. 4, the reference voltage generating section 20, reference voltage group changing circuit 23A, conversion and output section 21, and signal line changing circuit 23B are disposed together with the display section DS on the display panel 10. However, as shown in FIG. 5, the reference voltage generating section 20 may be disposed on a driving circuit board 30 which is independent of the display panel 10. Moreover, as shown in FIG. 6, the reference voltage group changing circuit 23A may be disposed together with the reference voltage generating section 20 on the driving circuit board 30. Furthermore, as shown in FIG. 7, the conversion and output section 21 may be disposed together with the reference voltage generating section 20 and reference voltage group changing circuit 23A on the driving circuit board 30.

Further, in the first embodiment, the signal line changing circuit 23B is configured to simultaneously select the signal lines for the red, green, or blue pixels in each sub-array as shown in FIG. 3. Generally, the gate of the driving element 17 in each display pixel PX is caused to float electrically when the pixel switch 13 is turned off. Therefore, the gate is easily influenced by potential fluctuation in the adjacent signal line 12 because of capacitive coupling to the gate wiring. In the case where the signal lines 12 for the red, green, and blue pixels are driven for each horizontal scanning period in the order shown in (a) of FIG. 8A, the original gradation voltage cannot be maintained since the potentials of the signal lines 12 excluding the outermost two of the signal lines 12 fluctuate in the following manner. Every horizontal scanning period, the potential of each signal line for the red pixel fluctuates twice, that of each signal line for the green pixel fluctuates once, and that of each signal line for the blue pixel does not fluctuate. That is, when the signal lines 12 are driven in the aforementioned order, the potentials of the plurality of signal lines 12 easily and non-uniformly fluctuate due to the video signals in the adjacent signal lines. In order to reduce the whole potential fluctuation, it is preferable that the signal lines 12 are driven in the order shown in (b)-1, (b)-2, (c)-1, (c)-2, (d) or (e) of FIGS. 8A and 8B, for example.

An organic EL display device according to a second embodiment of the present invention will be described hereinafter with reference to FIG. 9. This organic EL display device is similar to the organic EL display device of the first embodiment shown in FIG. 2 except for the configuration for causing the above-described influence due to potential fluctuation of the adjacent signal lines 12 to be uniform. Therefore, similar parts in FIG. 9 are denoted by the same reference numerals, and description thereof is simplified or omitted.

Figure 9:
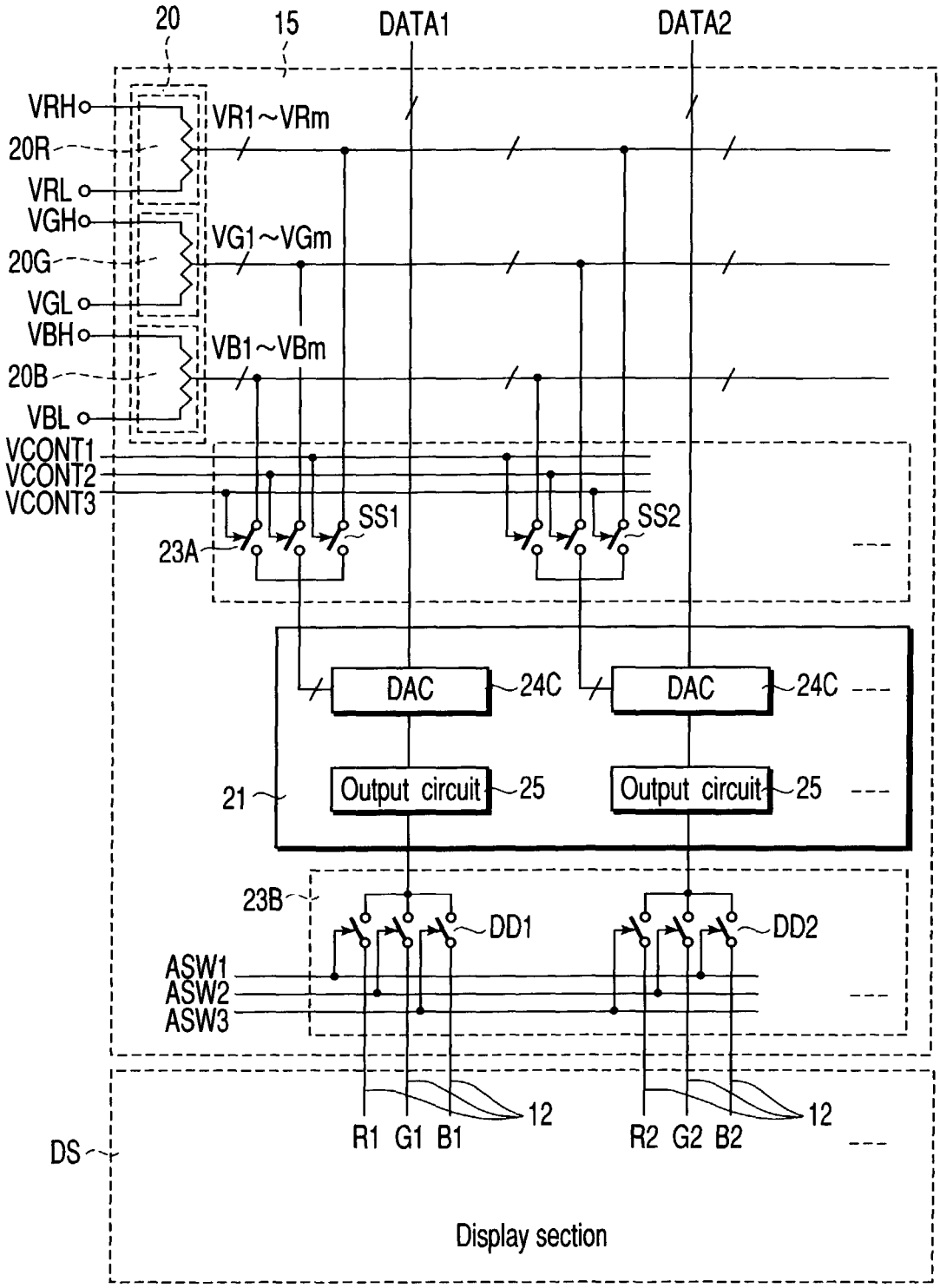
FIG. 9 is a circuit diagram showing the configuration of a signal line driver of an organic EL display device according to a second embodiment of the present invention.

Concretely, as shown in FIG. 9, gradation data DATA 1, DATA 2, . . . is independently supplied to the DAC modules disposed for the respective signal line blocks. Furthermore, the reference voltage group changing circuit 23A includes switch groups SS1, SS2, . . . assigned to the signal line blocks. The switch groups SS1, SS3, SS5, . . . are assigned to the odd-numbered signal line blocks. Each switch group includes m switches for selecting the reference voltages VR1 to VRm when the changing control signal VCONT1 is at high level, m switches for selecting the reference voltages VG1 to VGm when the changing control signal VCONT2 is at high level, and m switches for selecting the reference voltages VB1 to VBm when the changing control signal VCONT3 is at high level, and supplies the gradation reference voltage groups for red, green, and blue to the corresponding DAC modules assigned to the odd-numbered signal line blocks. Moreover, the switch groups SS2, SS4, SS6, . . . are assigned to the even-numbered signal line blocks. Each switch group includes m switches for selecting the reference voltages VB1 to VBm when the changing control signal VCONT1 is at high level, m switches for selecting the reference voltages VG1 to VGm when the changing control signal VCONT2 is at high level, and m switches for selecting the reference voltages VR1 to VRm when the changing control signal VCONT3 is at high level, and supplies the gradation reference voltage groups for red, green, and blue to the corresponding DAC modules assigned to the even-numbered signal line blocks. That is, the order of changing the gradation reference voltage groups for red, green, and blue is reversed between the switch groups SS1, SS3, SS5, . . . and the switch groups SS2, SS4, SS6, . . . .

The signal line changing circuit 23B includes switch groups DD1, DD2, . . . assigned to the signal line blocks. The switch groups DD1, DD3, DD5, . . . are assigned to the odd-numbered signal line blocks. Each switch group includes a switch for selecting the signal line 12 for the red pixel with respect to the corresponding output circuit 25 when the changing control signal ASW1 is at high level, a switch for selecting the signal line 12 for the green pixel with respect to the corresponding output circuit 25 when the changing control signal ASW2 is at high level, and a switch for selecting the signal line 12 for the blue pixel with respect to the corresponding output circuit 25 when the changing control signal ASW3 is at high level. The switch groups DD2, DD4, DD6, . . . are assigned to the even-numbered signal line blocks. Each switch group includes a switch for selecting the signal line 12 for the blue pixel with respect to the corresponding output circuit 25 when the changing control signal ASW1 is at high level, a switch for selecting the signal line 12 for the green pixel with respect to the corresponding output circuit 25 when the changing control signal ASW2 is at high level, and a switch for selecting the signal line 12 for the red pixel with respect to the corresponding output circuit 25 when the changing control signal ASW3 is at high level. The switch groups DD1, DD2, . . . supply the analog video signals for red obtained from the output circuits 25 to the corresponding signal lines 12 for the red pixels, supply the analog video signals for green obtained from the output circuits 25 to the corresponding signal lines 12 for the green pixels, and further supply the analog video signals for blue obtained from the output circuits 25 to the corresponding signal lines 12 for the blue pixels. That is, the order of changing the signal lines 12 for the red, green, and blue pixels is reversed between the switch groups DD1, DD3, DD5, . . . and the switch groups DD2, DD4, DD6, . . . .

Figure 10:
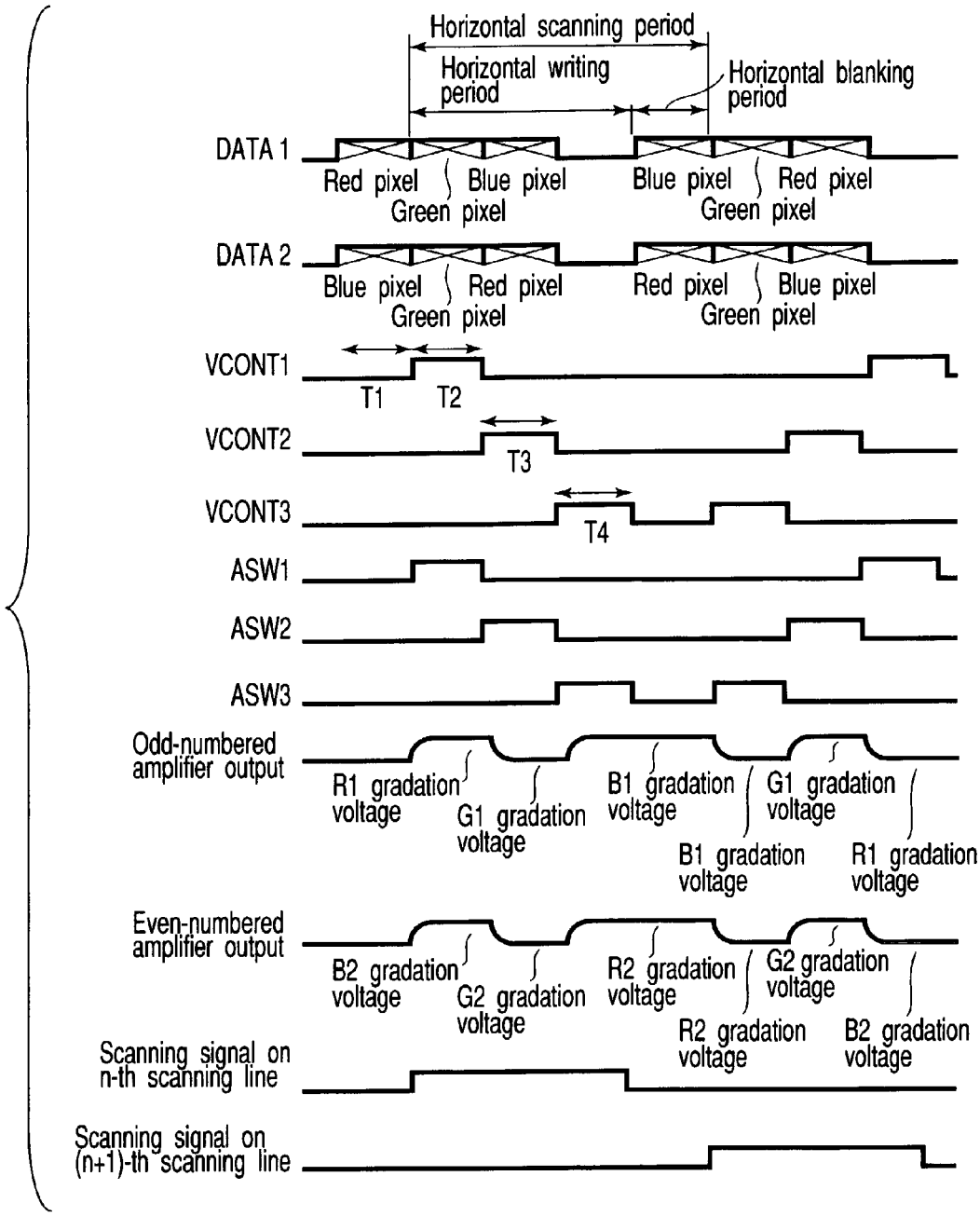
FIG. 10 is a timing chart showing the operation of the signal line driver shown in FIG. 9.

FIG. 10 shows the operation of the organic EL display device. In the organic EL display device, the gradation data DATA1, DATA2, . . . for the red, green, and blue pixels is sequentially supplied as digital video signals for the odd-numbered and even-numbered signal line blocks. Concretely, the gradation data DATA1 for the red pixel, the gradation data DATA1 for the green pixel, and the gradation data DATA1 for the blue pixel is supplied to a certain signal line block in the periods T1, T2, and T3, respectively. Moreover, in parallel to this, the gradation data DATA2 for the blue pixel, the gradation data DATA2 for the green pixel, and gradation data DATA2 for the red pixel are supplied to the adjacent signal line block in the periods T1, T2, and T3, respectively. In this manner, gradation data DATAn rearranged for the respective signal line blocks is supplied, and the latch circuit 24B sequentially supplies the gradation data DATAn latched in the periods T1, T2, and T3 to the DAC modules of the digital-to-analog converters 24C in response to the load signal LOAD.

In the conversion circuit 24 in the odd-numbered stage, the latch circuit 24B latches the gradation data DATA1 for the red pixel in the period T1, and supplies the data to the DAC module in the odd-numbered stage in response to the load signal LOAD in the period T2. In the period T2, the changing control signals VCONT1 and ASW1 are kept at high level. Thereby, the DAC module refers to the gradation reference voltage group VR1 to VRm from the voltage generator 20R to convert the gradation data DATA1 for the red pixel to an analog gradation voltage, and supplies the voltage to the output circuit 25. The gradation voltage is amplified by the output amplifier 25A, and supplied as an analog video signal to the corresponding signal line 12 for the red pixel in the signal line block. Furthermore, the latch circuit 24B latches the gradation data DATA1 for the green pixel in the period T2, and supplies the data to the DAC module in response to the load signal LOAD in the period T3. The changing control signals VCONT2 and ASW2 are kept at high level in the period T3. Thereby, the DAC module in the odd-numbered stage refers to the gradation reference voltage group VG1 to VGm from the voltage generator 20G to convert the gradation data DATA1 for green to an analog gradation voltage, and supplies the voltage to the output amplifier of the odd-numbered stage. The gradation voltage is amplified by the output amplifier 25A, and supplied as an analog video signal to the corresponding signal line 12 for the green pixel in the signal line block. Moreover, the latch circuit 24B latches the gradation data DATA1 for the blue pixel in the period T3, and supplies the data to the DAC module of the odd-numbered stage in response to the load signal LOAD in the period T4. The changing control signals VCONT3 and ASW3 are kept at high level in the period T4. Thereby, the digital-to-analog converter 24C refers to the gradation reference voltage group from the voltage generator 20B to convert the gradation data DATA1 for the blue pixel to an analog gradation voltage, and supplies the voltage to the output circuit 25. The gradation voltage is amplified by the output amplifier 25A, and supplied as an analog video signal to the corresponding signal line 12 for the blue pixel in the signal line block of the odd-numbered stage.

On the other hand, in the conversion circuit 24 in the even-numbered stage, the latch circuit 24B latches the gradation data DATA2 for the blue pixel in the period T1, and supplies the data to the DAC module in the even-numbered stage in response to the load signal LOAD in the period T2. In the period T2, the changing control signals VCONT1 and ASW1 are kept at high level. Thereby, the DAC module refers to the gradation reference voltage group from the voltage generator 20B to convert the gradation data DATA2 for the blue pixel to an analog gradation voltage, and supplies the voltage to the output circuit 25. The gradation voltage is amplified by the output amplifier 25A, and supplied as an analog video signal to the corresponding signal line 12 for the blue pixel in the signal line block of the even-numbered stage. Furthermore, the latch circuit 24B latches the gradation data DATA2 for the green pixel in the period T2, and supplies the data to the DAC module in response to the load signal LOAD in the period T3. The changing control signals VCONT2 and ASW2 are kept at high level in the period T3. Thereby, the DAC module in the even-numbered stage refers to the gradation reference voltage group from the voltage generator 20G to convert the gradation data DATA2 for green to an analog gradation voltage, and supplies the voltage to the output circuit 25. The gradation voltage is amplified by the output amplifier 25A, and supplied as an analog video signal to the corresponding signal line 12 for the green pixel in the signal line block of the even-numbered stage. Moreover, the latch circuit 24B latches the gradation data DATA2 for the red pixel in the period T3, and supplies the data to the DAC module in response to the load signal LOAD in the period T4. The changing control signals VCONT3 and ASW3 are kept at high level in the period T4. Thereby, the DAC module of the even-numbered stage refers to the gradation reference voltage group from the voltage generator 20R to convert the gradation data DATA2 for the red pixel to an analog gradation voltage, and supplies the voltage to the output circuit 25. The gradation voltage is amplified by the output amplifier 25A, and supplied as an analog video signal to the corresponding signal line 12 for the red pixel in the signal line block.

When the plurality of signal lines 12 are driven in one horizontal scanning period in this manner, the selection orders of the gradation data, gradation reference voltage groups, and signal lines are reversed in the subsequent horizontal scanning period, the above-described operation being repeated to display an image of one frame. Furthermore, also for the next frame period (vertical scanning period), the selection orders of the gradation data, gradation reference voltage groups, and signal lines are reversed for each horizontal scanning period. Thereby, the plurality of signal lines 12 are driven in an order that ensures potential fluctuation is minimized as shown in (e) of FIG. 8B. In addition, the rising timings of the changing control signals VCONT1 and ASW1, VCONT2 and ASW2, and VCONT3 and ASW3 may be determined such that the signal lines 12 are driven in the order shown in one of (b)-1, (b)-2, (c)-1, (c)-2, and (d) of FIGS. 8A and 8B.

Moreover, the signal line block includes 3×n adjacent signal lines (n=1 herein) as has been described in the first embodiment. However, the second embodiment is not limited to this: a predetermined number of signal lines 12 may also form one signal line block, and it is important that the reference voltage group changing circuit include a group of switches for selecting the voltage generators of the respective colors with respect to one DAC module.

In the organic EL display device of the second embodiment, the order of driving the signal lines 12 for each horizontal scanning period is optimized to reduce the number of potential changes in each signal line 12 in an electrically floating state. Further, since the order of driving the signal lines 12 is changed in at least one of the predetermined vertical and horizontal scanning periods, the pixels whose written voltages fluctuate can be dispersed in time or space. Moreover, similar effects to those of the first embodiment can be obtained in addition to the above-described effects.

Figure 11:
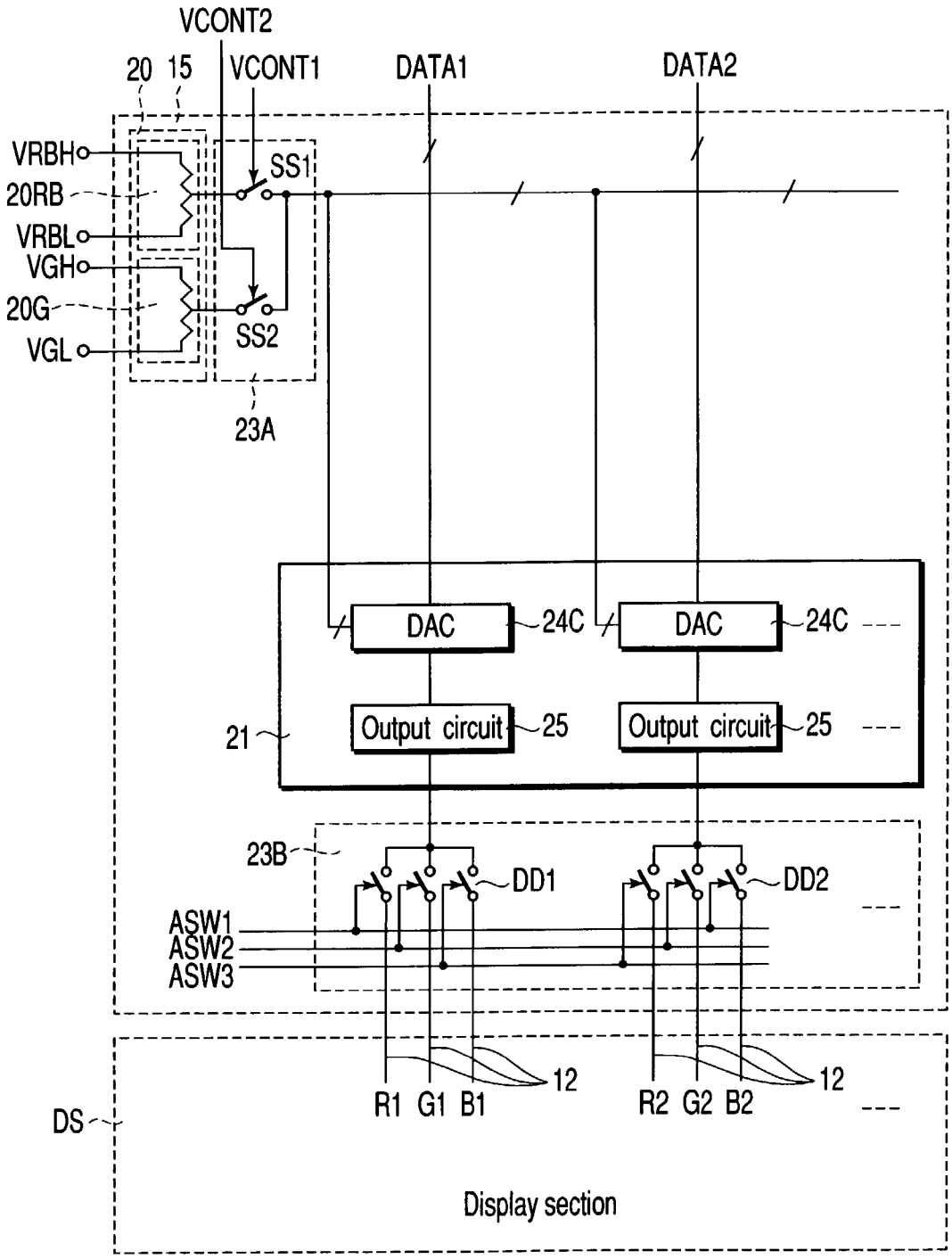
FIG. 11 is a circuit diagram showing the configuration of a signal line driver of an organic EL display device according to a third embodiment of the present invention.

An organic EL display device according to a third embodiment of the present invention will be described hereinafter with reference to FIG. 11. This organic EL display device is similar to the organic EL display device of the second embodiment shown in FIG. 9 except for the configuration for causing the above-described influence due to potential fluctuation of the adjacent signal lines 12 to be uniform and using a common voltage generator for the colors. Therefore, similar parts in FIG. 11 are denoted by the same reference numerals, and description thereof is simplified or omitted.

Concretely, a gradation reference voltage group is used in common for those colors (e.g., red and blue) of a luminescent material that have substantially the same gamma characteristics. As shown in FIG. 11, the reference voltage generating section 20 includes a voltage generator 20RB which generates a gradation reference voltage group for red and blue and a voltage generator 20G which generates a gradation reference voltage group for green. The voltage generator 20RB is a voltage dividing circuit for dividing a power source voltage for red and blue supplied between reference power terminals VRBL and VRBH by means of resistors corresponding to the gradation number m of the gradation data DATA so as to generate the gradation reference voltage group for red and blue, that is, m reference voltages VRB1 to VRBm. The voltage generator 20G is a voltage dividing circuit for dividing a power source voltage for green supplied between reference power terminals VGL and VGH by means of resistors corresponding to the gradation number m of the gradation data DATA so as to generate the gradation reference voltage group for green, that is, m reference voltages VG1 to VGm. The reference voltages of the gradation reference voltage groups for red and blue and for green are properly determined to perform gamma correction to eliminate the distortion of the white balance and gradation between the organic EL elements 16.

Furthermore, the reference voltage group changing circuit 23A includes the switch groups SS1, SS2, . . . assigned to a plurality of signal line blocks. The switch groups SS1, SS2 . . . include m switches for selecting the reference voltages VRB1 to VRBm when the changing control signal VCONT1 is at high level, and m switches for selecting the reference voltages VG1 to VGm when the changing control signal VCONT2 is at high level, and supply the gradation reference voltage groups for red and blue and for green to the DAC modules assigned to the signal line blocks.

The signal line changing circuit 23B includes switch groups DD1, DD2, . . . assigned to the plurality of signal line blocks. The switch groups DD1, DD3, DD5, . . . are assigned to the odd-numbered signal line blocks. Each switch group includes a switch for select the signal line 12 for the red pixel with respect to the corresponding output circuit 25 when the changing control signal ASW1 is at high level, a switch for selecting the signal line 12 for the green pixel with respect to the corresponding output circuit 25 when the changing control signal ASW2 is at high level, and a switch for selecting the signal line 12 for the blue pixel with respect to the corresponding output circuit 25 when the changing control signal ASW3 is at high level. The switch groups DD2, DD4, DD6, . . . are assigned to the even-numbered signal line blocks. Each switch group includes a switch for selecting the signal line 12 for the blue pixel with respect to the corresponding output circuit 25 when the changing control signal ASW1 is at high level, a switch for selecting the signal line 12 for the green pixel with respect to the corresponding output circuit 25 when the changing control signal ASW2 is at high level, and a switch for selecting the signal line 12 for the red pixel with respect to the corresponding output circuit 25 when the changing control signal ASW3 is at high level. Each of the switch groups DD1, DD2, . . . supplies the analog video signal for red obtained from the corresponding output circuit 25 to the signal line 12 for the red pixel, supplies the analog video signal for green obtained from the corresponding output circuit 25 to the signal line 12 for the green pixel, and further supplies the analog video signal for blue obtained from the corresponding output circuit 25 to the signal line 12 for the blue pixel. That is, the order of changing the signal lines 12 for the red, green, and blue pixels is reversed between the switch groups DD1, DD3, DD5, . . . and the switch groups DD2, DD4, DD6 . . . .

Figure 12:
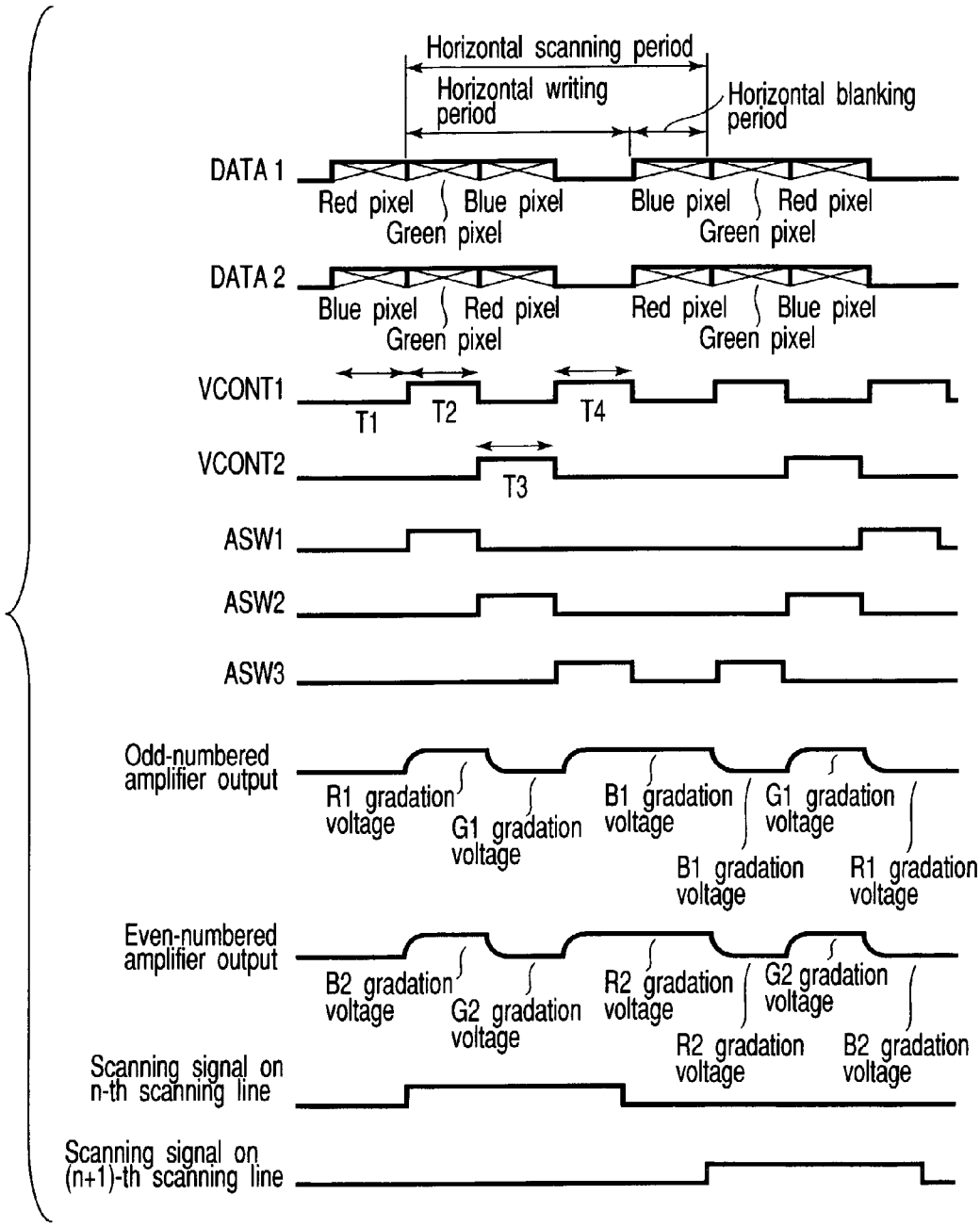
FIG. 12 is a timing chart showing the operation of the signal line driver shown in FIG. 11.

FIG. 12 shows the operation of the organic EL display device. In the organic EL display device, the gradation data DATA1, DATA2, . . . for the red, green, and blue pixels is supplied as digital video signals to the signal line blocks every horizontal scanning period. Concretely, the gradation data DATA1 for the red, green, and blue pixels is supplied to the odd-numbered signal line block in the periods T1, T2, and T3, respectively. Moreover, parallel to this, the gradation data DATA2 for the blue, green, and red pixels is supplied to the even-numbered signal line block in the periods T1, T2, and T3, respectively.

In each odd-numbered stage of the conversion circuit 24, the latch circuit 24B latches the gradation data DATA1 for the red pixel in the period T1, and supplies the data to the DAC module in the odd-numbered stage in response to the load signal LOAD in the period T2. In the period T2, the changing control signals VCONT1 and ASW1 are kept at high level. Thereby, the DAC module refers to the gradation reference voltage group VRB1 to VRBm from the voltage generator 20RB to convert the gradation data DATA1 for red to an analog gradation voltage, and supplies the voltage to the output circuit 25. The gradation voltage is amplified by the output circuit 25, and supplied as an analog video signal to the signal line 12 for the red pixel in the corresponding signal line block. Furthermore, the latch circuit 24B latches the gradation data DATA1 for the green pixel in the period T2, and supplies the data to the DAC module in response to the load signal LOAD in the period T3. The changing control signals VCONT2 and ASW2 are kept at high level in the period T3. Thereby, the DAC module refers to the gradation reference voltage group VG1 to VGm from the voltage generator 20G to convert the gradation data DATA1 for green to an analog gradation voltage, and supplies the voltage to the output circuit 25. The gradation voltage is amplified by the output circuit 25, and supplied as an analog video signal to the signal line 12 for the green pixel in the corresponding signal line block. Further, the latch circuit 24B latches the gradation data DATA1 for the blue pixel in the period T3, and supplies the data to the DAC module in response to the load signal LOAD in the period T4. The changing control signals VCONT1 and ASW3 are kept at high level in the period T4. Thereby, the DAC module refers to the gradation reference voltage group VRB1 to VRBm from the voltage generator 20RB to convert the gradation data DATA1 for the blue pixel to an analog gradation voltage, and supplies the voltage to the output circuit 25. The gradation voltage is amplified by the output circuit 25, and supplied as an analog video signal to the signal line 12 for the blue pixel in the corresponding signal line block.

On the other hand, in each even-numbered stage of the conversion circuit 24, the latch circuit 24B latches the gradation data DATA2 for the blue pixel in the period T1, and supplies the data to the DAC module in response to the load signal LOAD in the period T2. In the period T2, the changing control signals VCONT1 and ASW1 are kept at high level. Thereby, the DAC module refers to the gradation reference voltage group VRB1 to VRBm from the voltage generator 20RB to convert the gradation data DATA2 for the blue pixel to an analog gradation voltage, and supplies the voltage to the output circuit 25. The gradation voltage is amplified by the output circuit 25, and supplied as an analog video signal to the signal line 12 for the blue pixel in the corresponding signal line block. Furthermore, the latch circuit 24B latches the gradation data DATA2 for the green pixel in the period T2, and supplies the data to the DAC module in response to the load signal LOAD in the period T3. The changing control signals VCONT2 and ASW2 are kept at high level in the period T3. Thereby, the DAC module refers to the gradation reference voltage group VG1 to VGm from the voltage generator 20G to convert the gradation data DATA2 for green to an analog gradation voltage, and supplies the voltage to the output circuit 25. The gradation voltage is amplified by the output circuit, and supplied as an analog video signal to the signal line 12 for the green pixel in the corresponding signal line block. Further, the latch circuit 24B latches the gradation data DATA2 for the red pixel in the period T3, and supplies the data to the DAC module in response to the load signal LOAD in the period T4. The changing control signals VCONT1 and ASW3 are kept at high level in the period T4. Thereby, the DAC module refers to the gradation reference voltage group VRB1 to VRBm from the voltage generator 20RB to convert the gradation data DATA2 for the red pixel to an analog gradation voltage, and supplies the voltage to the output circuit 25. The gradation voltage is amplified by the output circuit 25, and supplied as an analog video signal to the signal line 12 for the red pixel in the corresponding signal line block.

When the plurality of signal lines 12 are driven in one horizontal scanning period as described above, the selection orders of the gradation data, gradation reference voltage groups, and signal lines are reversed in the next horizontal scanning period. The above-described operation is repeated to display an image. Furthermore, also for the next frame period (vertical scanning period), the selection orders of the gradation data, gradation reference voltage groups, and signal lines are reversed for each horizontal scanning period. Thereby, the plurality of signal lines 12 are driven in an order that ensures the potential fluctuation is minimized as shown in (e) of FIG. 8B. In addition, the rising timings of the changing control signals VCONT1 and ASW1, VCONT2 and ASW2, and VCONT3 and ASW3 may be determined such that the signal lines 12 are driven in the order shown in one of (b)-1, (b)-2, (c)-1, (c)-2, and (d) of FIGS. 8A and 8B.

In the organic EL display device of the third embodiment, as with the second embodiment, the order of driving the signal lines 12 for each horizontal scanning period is optimized to reduce the number of potential changes in each signal line 12 in an electrically floating state. Further, since the order of driving the signal lines 12 is changed in at least one of the predetermined vertical and horizontal scanning periods, the pixels whose written voltages fluctuate can be dispersed in time or space. Furthermore, in the reference voltage generating section 20, since the gradation reference voltage group generated by the voltage generator 20RB is used in common for the digital-to-analog conversion of the gradation data for red and blue, the scale of the signal line driver 15 can be further reduced.

An organic EL display device according to a fourth embodiment of the present invention will be described hereinafter with reference to FIG. 13. In the organic EL display device, the influence of potential fluctuation of the adjacent signal lines 12 is made uniform, while the voltage generator is common to different colors. This device is similar to the organic EL display device of the second embodiment shown in FIG. 9 except for the configuration of using the voltage generator in common for red and green and having signal line blocks each formed of 3×2 (6) signal lines. Therefore, similar parts in FIG. 13 are denoted with the same reference numerals, and description thereof is simplified or omitted.

Figure 13:
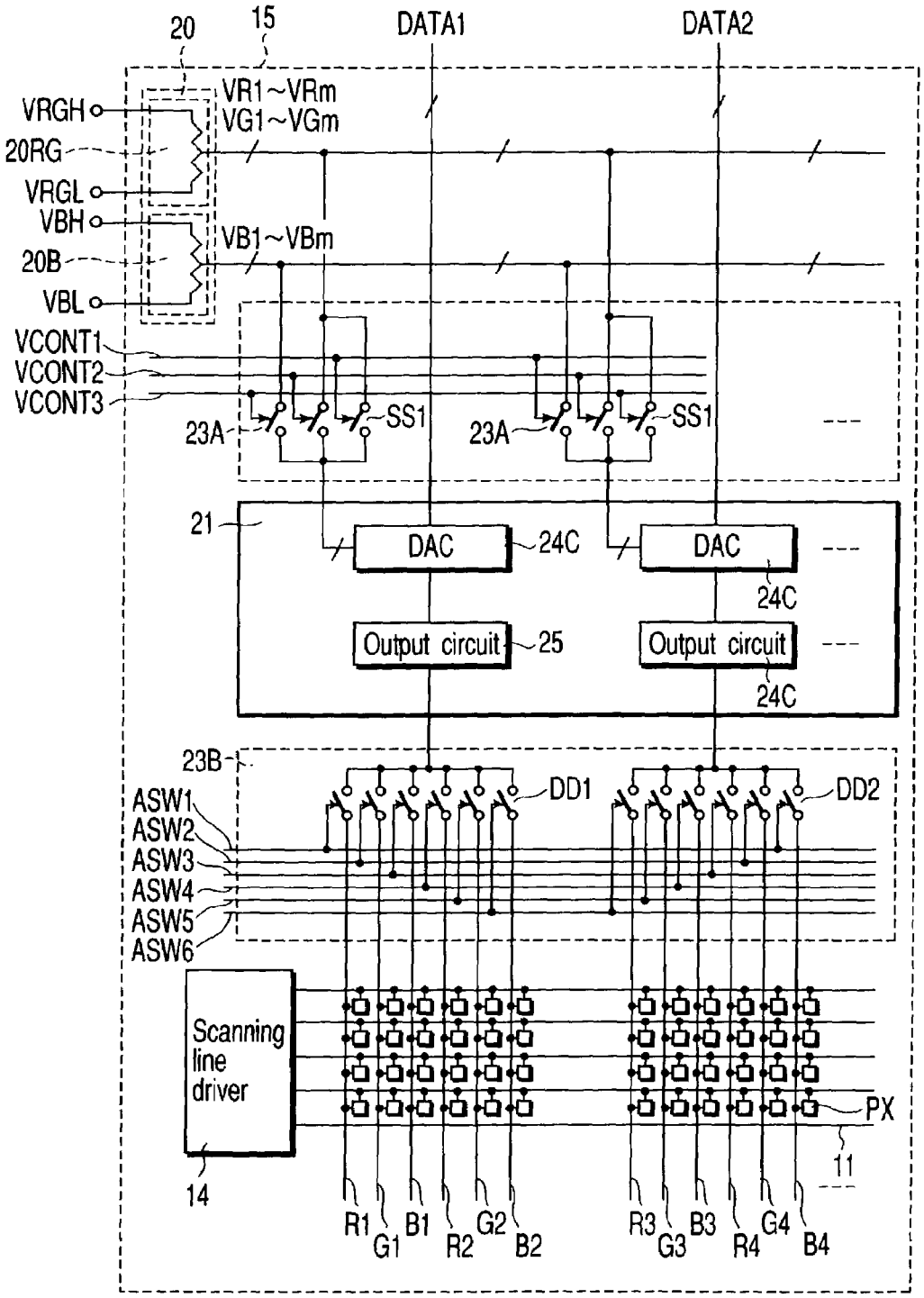
FIG. 13 is a circuit diagram showing the configuration of a signal line driver of an organic EL display device according to a fourth embodiment of the present invention.

Concretely, as shown in FIG. 13, the reference voltage generating section 20 includes a voltage generator 20RG which generates a gradation reference voltage group for red and green and a voltage generator 20B which generates a gradation reference voltage group for blue. The voltage generator 20RG is a voltage dividing circuit for dividing the power source voltage for red supplied between reference power terminals VRGL and VRGH by means of resistors to generate the gradation reference voltage group for red, that is, m reference voltages VR1 to VRm, and for dividing the power source voltage for green supplied between reference power terminals VRGL and VRGH by means of resistors to generate the gradation reference voltage group for green, that is, m reference voltages VG1 to VGm. The voltage generator 20B is a voltage dividing circuit for dividing the power source voltage for blue supplied between reference power terminals VBL and VBH by means of resistors to generate the gradation reference voltage group for blue, that is, m reference voltages VB1 to VBm. Here, the reference voltages of the gradation reference voltage groups for red and green and for blue are properly determined to perform gamma correction to eliminate distortion of white balance and gradation between the organic EL elements 16.

Furthermore, the signal line changing circuit 23B is formed in the same manner as that of the first embodiment. The switch groups SS1, SS2, . . . of the reference voltage group changing circuit 23A are formed as follows. That is, the switch groups SS1, SS3, SS5, . . . are assigned to the even-numbered signal line blocks. Each switch group includes m switches for selecting the reference voltages VR1 to VRm when the changing control signal VCONT1 is at high level, m switches for selecting the reference voltages VG1 to VGm when the changing control signal VCONT2 is at high level, and m switches for selecting the reference voltages VB1 to VBm when the changing control signal VCONT3 is at high level, and supplies the gradation reference voltage groups for red and green and for blue to the conversion circuit 24 assigned to the corresponding odd-numbered signal line block. Moreover, the switch groups DD2, DD4, DD6, . . . are assigned to the even-numbered signal line blocks. Each switch group includes m switches for selecting the reference voltages VB1 to VBm when the changing control signal VCONT1 is at high level, m switches for selecting the reference voltages VG1 to VGm when the changing control signal VCONT2 is at high level, and m switches for selecting the reference voltages VR1 to VRm when the changing control signal VCONT3 is at high level, and supplies the gradation reference voltage groups for red and green and for blue to the conversion circuit 24 assigned to the corresponding even-numbered signal line block.

Figure 14:
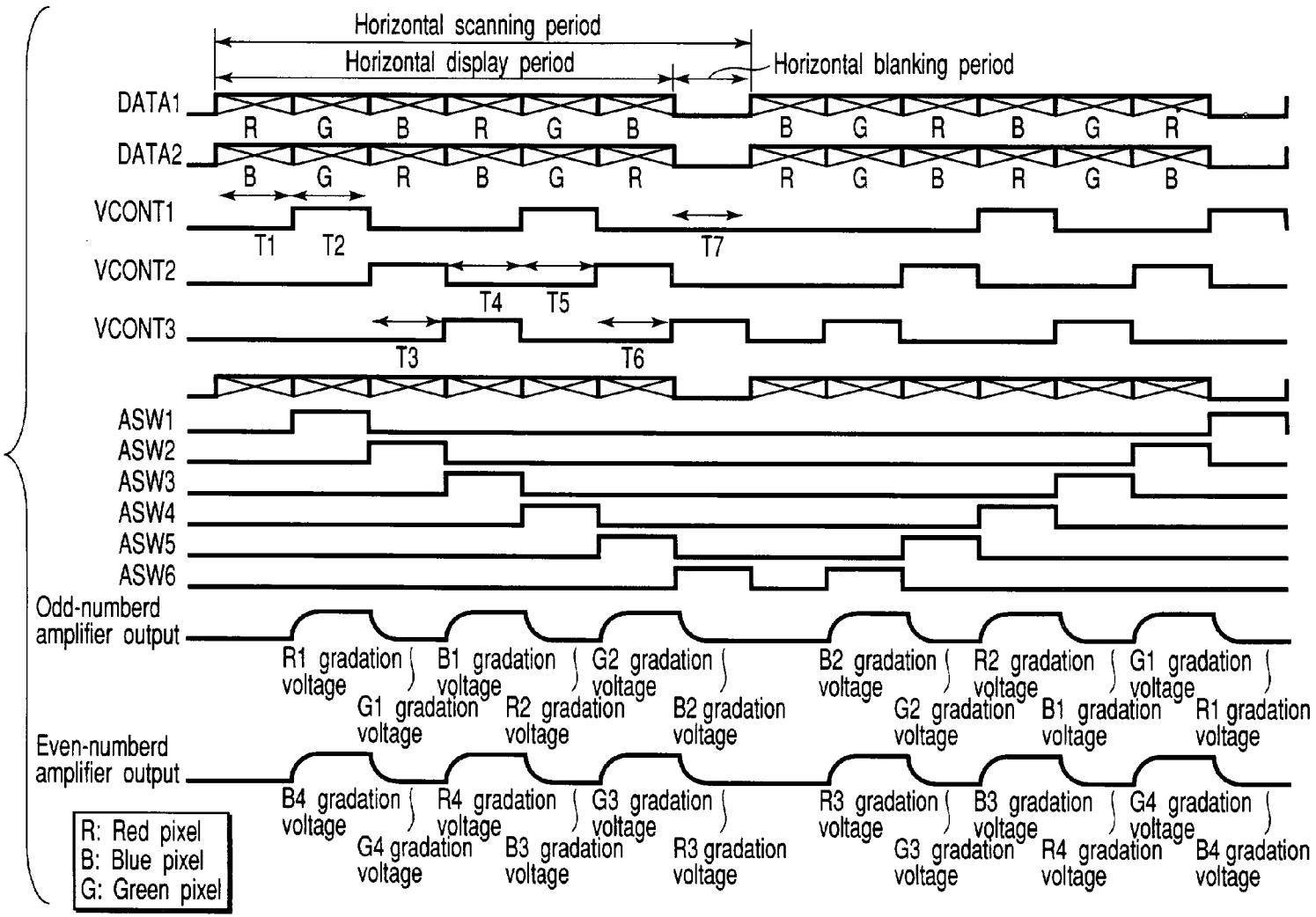
FIG. 14 is a timing chart showing the operation of the signal line driver shown in FIG. 13.

FIG. 14 shows the operation of the signal line driver 15. In the signal line driver 15, the gradation data DATA1, DATA2, . . . for the red, green, and blue pixels is supplied as digital video signals to the odd-numbered and even-numbered signal line blocks every horizontal scanning period. Concretely, the gradation data DATA1 for a red pixel R1, green pixel G1, blue pixel B1, red pixel R2, green pixel G2, and blue pixel B2 are supplied in periods T1, T2, T3, T4, T5, and T6 each of which is ⅙ of the horizontal writing period excluding the horizontal blanking period. Moreover, parallel to this, the gradation data DATA2 for a blue pixel B4, green pixel G4, red pixel R4, blue pixel B3, green pixel G3, and red pixel R3 are supplied in the periods T1, T2, T3, T4, T5, and T6, respectively.

In each odd-numbered stage of the conversion circuit 24, the latch circuit 24B latches the gradation data DATA1 for the red pixel R1 in the period T1, and supplies the data to the DAC module 24C in response to the load signal LOAD in the period T2. In the period T2, the changing control signals VCONT1 and ASW1 are kept at high level. Thereby, the DAC module 24C refers to the gradation reference voltage group (reference voltages VR1 to VRm) from the voltage generator 20RG to convert the gradation data DATA1 for the red pixel R1 to an analog gradation voltage, and supplies the voltage to the output circuit 25. The gradation voltage is supplied as an analog video signal to the signal line 12 for the red pixel R1 in the corresponding signal line block. Furthermore, the latch circuit 24B latches the gradation data DATA1 for the green pixel G1 in the period T2, and supplies the data to the DAC module 24C in response to the load signal LOAD in the period T3. The changing control signals VCONT2 and ASW2 are kept at high level in the period T3. Thereby, the DAC module 24C refers to the gradation reference voltage group (reference voltage VG1 to VGm) from the voltage generator 20RG to convert the gradation data DATA1 for the green pixel G1 to an analog gradation voltage, and supplies the voltage to the output circuit 25. The gradation voltage is supplied as an analog video signal to the signal line 12 for the green pixel G1 in the corresponding signal line block. Further, the latch circuit 24B latches the gradation data DATA1 for the blue pixel B1 in the period T3, and supplies the data to the DAC module 24C in response to the load signal LOAD in the period T4. The changing control signals VCONT3 and ASW3 are kept at high level in the period T4. Thereby, the DAC module 24C refers to the gradation reference voltage group (reference voltages VB1 to VBm) from the voltage generator 20B to convert the gradation data DATA1 for the blue pixel B1 to an analog gradation voltage, and supplies the voltage to the output circuit 25. The gradation voltage is supplied as an analog video signal to the signal line 12 for the blue pixel B1 in the corresponding signal line block. Moreover, the latch circuit 24B latches the gradation data DATA1 for the red pixel R2 in the period T4, and supplies the data to the DAC module 24C in response to the load signal LOAD in the period T5. The changing control signals VCONT1 and ASW4 are kept at high level in the period T5. Thereby, the DAC module 24C refers to the gradation reference voltage group (reference voltages VR1 to VRm) from the voltage generator 20RB to convert the gradation data DATA1 for the red pixel R2 to an analog gradation voltage, and supplies the voltage to the output circuit 25. The gradation voltage is supplied as an analog video signal to the signal line 12 for the red pixel R2 in the corresponding signal line block. Furthermore, the latch circuit 24B latches the gradation data DATA1 for the green pixel G2 in the period T5, and supplies the data to the DAC module 24C in response to the load signal LOAD in the period T6. The changing control signals VCONT2 and ASW5 are kept at high level in the period T6. Thereby, the DAC module 24C refers to the gradation reference voltage group (reference voltages VG1 to VGm) from the voltage generator 20RG to convert the gradation data DATA1 for the green pixel G2 to an analog gradation voltage, and supplies the voltage to the output circuit 25. The gradation voltage is supplied as an analog video signal to the signal line 12 for the green pixel G2 in the corresponding signal line block. Further, the latch circuit 24B latches the gradation data DATA1 for the blue pixel B2 in the period T6, and supplies the data to the DAC module 24C in response to the load signal LOAD in the period T7. The changing control signals VCONT3 and ASW6 are kept at high level in the period T7. Thereby, the DAC module 24C refers to the gradation reference voltage group (reference voltages VB1 to VBm) from the voltage generator 20B to convert the gradation data DATA1 for the blue pixel B2 to an analog gradation voltage, and supplies the voltage to the output circuit 25. The gradation voltage is supplied to the signal line 12 for the blue pixel B2 in the corresponding signal line block.

On the other hand, in the even-numbered stage of the conversion circuit 24, the latch circuit 24B latches the gradation data DATA2 for the blue pixel B4 in the period T1, and supplies the data to the DAC module 24C in response to the load signal LOAD in the period T2. In the period T2, the changing control signals VCONT1 and ASW1 are kept at high level. Thereby, the DAC module 24C refers to the gradation reference voltage group (reference voltages VB1 to VBm) from the voltage generator 20B to convert the gradation data DATA2 for the blue pixel B4 to an analog gradation voltage, and supplies the voltage to the output circuit 25. The gradation voltage is supplied as an analog video signal to the signal line 12 for the blue pixel B4 in the corresponding signal line block. Furthermore, the latch circuit 24B latches the gradation data DATA2 for the green pixel G4 in the period T2, and supplies the data to the DAC module 24C in response to the load signal LOAD in the period T3. The changing control signals VCONT2 and ASW2 are kept at high level in the period T3. Thereby, the DAC module 24C refers to the gradation reference voltage group for green (reference voltages VG1 to VGm) from the voltage generator 20RG to convert the gradation data DATA2 for the green pixel G4 to an analog gradation voltage, and supplies the voltage to the output circuit 25. The gradation voltage is supplied as an analog video signal to the signal line 12 for the green pixel G4 in the corresponding signal line block. Further, the latch circuit 24B latches the gradation data DATA2 for the red pixel R4 in the period T3, and supplies the data to the DAC module 24C in response to the load signal LOAD in the period T4. The changing control signals VCONT3 and ASW3 are kept at high level in the period T4. Thereby, the DAC module 24C refers to the gradation reference voltage group for red (reference voltages VR1 to VRm) from the voltage generator 20RG to convert the gradation data DATA2 for the red pixel R4 to an analog gradation voltage, and supplies the voltage to the output circuit 25. The gradation voltage is supplied as an analog video signal to the signal line 12 for the red pixel R4 in the corresponding signal line block. Furthermore, the latch circuit 24B latches the gradation data DATA2 for the blue pixel B3 in the period T4, and supplies the data to the DAC module 24C in response to the load signal LOAD in the period T5. The changing control signals VCONT1 and ASW4 are kept at high level in the period T5. Thereby, the DAC module 24C refers to the gradation reference voltage group (reference voltages VB1 to VBm) from the voltage generator 20B to convert the gradation data DATA2 for the blue pixel B3 to an analog gradation voltage, and supplies the voltage to the output circuit 25. The gradation voltage is supplied as an analog video signal to the signal line 12 for the blue pixel B3 in the corresponding signal line block. Further, the latch circuit 24B latches the gradation data DATA2 for the green pixel G3 in the period T5, and supplies the data to the DAC module 24C in response to the load signal LOAD in the period T6. The changing control signals VCONT2 and ASW5 are kept at high level in the period T6. Thereby, the DAC module 24C refers to the gradation reference voltage group (reference voltages VG1 to VGm) from the voltage generator 20RG to convert the gradation data DATA2 for the green pixel G3 to an analog gradation voltage, and supplies the voltage to the output circuit 25. The gradation voltage is supplied as an analog video signal to the signal line 12 for the green pixel G3 in the corresponding signal line block. Moreover, the latch circuit 24B latches the gradation data DATA2 for the red pixel R3 in the period T6, and supplies the data to the DAC module 24C in response to the load signal LOAD in the period T7. The changing control signals VCONT3 and ASW6 are kept at high level in the period T7. Thereby, the DAC module 24C refers to the gradation reference voltage group (reference voltages VR1 to VRm) from the voltage generator 20RG to convert the gradation data DATA2 for the red pixel R3 to an analog gradation voltage, and supplies the voltage to the output circuit 25. The gradation voltage is supplied as a analog video signal to the signal line 12 for the red pixel R3 in the corresponding signal line block.

When the plurality of signal lines 12 are driven in one horizontal scanning period as described above, the selection orders of the gradation data, gradation reference voltage groups, and signal lines are reversed in the next horizontal scanning period. The above-described operation is repeated to display an image. Furthermore, also for the next frame period (vertical scanning period), the selection orders of the gradation data, gradation reference voltage groups, and signal lines are reversed for each horizontal scanning period. In addition, the rising timings of the changing control signals VCONT1 and ASW1, VCONT2 and ASW2, VCONT3 and ASW3, VCONT1 and ASW4, VCONT2 and ASW5, and VCONT3 and ASW6 may be determined such that the signal lines 12 are driven in the order shown in one of (b)-1, (b)-2, (c)-1, (c)-2, and (d) of FIGS. 8A and 8B.

In the organic EL display device of the fourth embodiment, as with the third embodiment, the order of driving the signal lines 12 for each horizontal scanning period is optimized to reduce the number of potential changes in each signal line 12 in an electrically floating state. Further, since the order of driving the signal lines 12 is changed in at least one of the predetermined vertical and horizontal scanning periods, the pixels whose gradation voltages fluctuate can be dispersed in time or space. Furthermore, in the reference voltage generating section 20, since the reference voltage supplied to the reference voltage terminals VRGH, VRGL of the voltage generator 20RG is varied to output the gradation reference voltage groups for the red and green pixels, the scale of the signal line driver 15 can be reduced.

Figure 15:
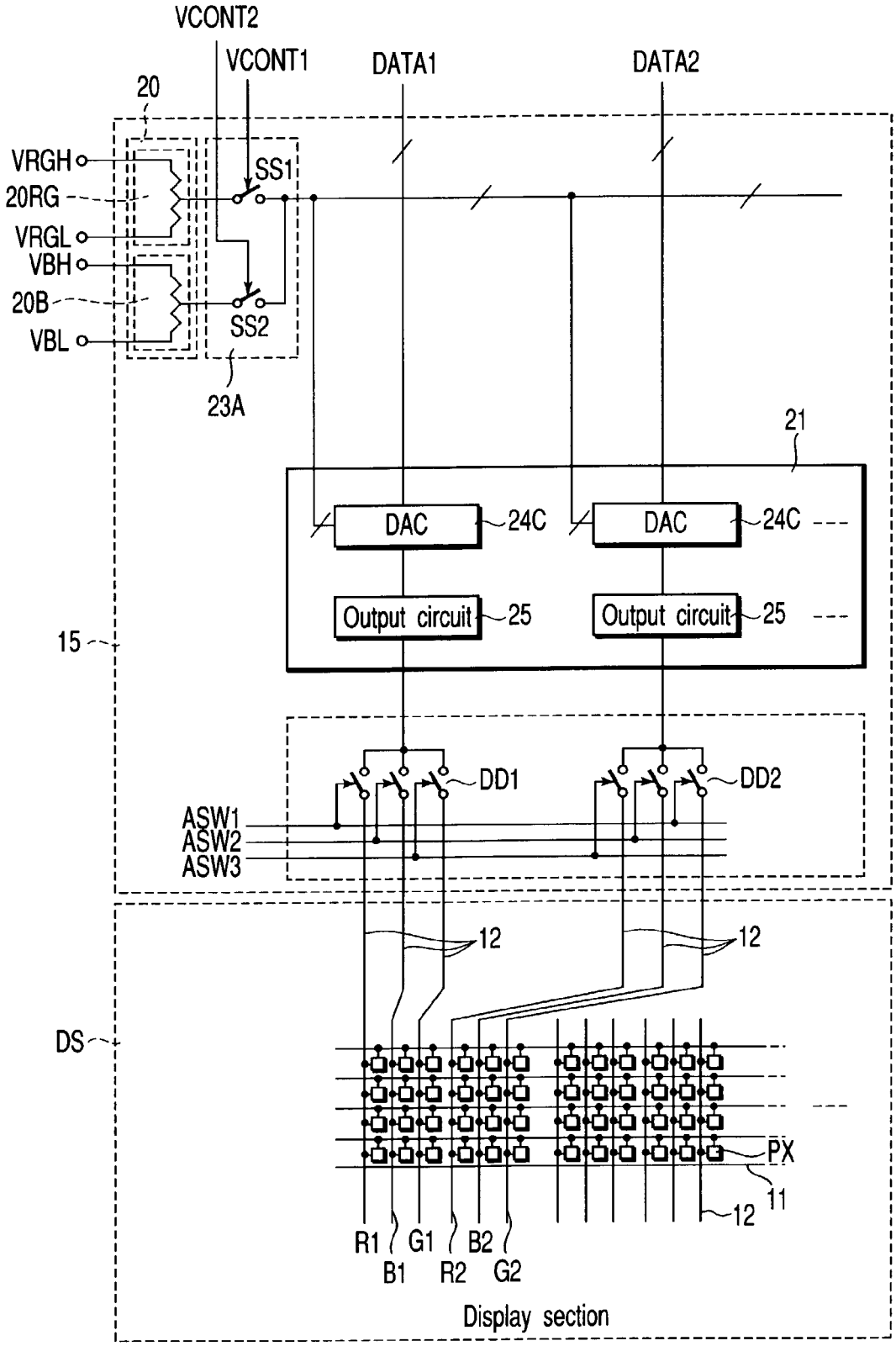
FIG. 15 is a circuit diagram showing the configuration of a signal line driver of an organic EL display device according to a fifth embodiment of the present invention.

An organic EL display device according to a fifth embodiment of the present invention will be described hereinafter with reference to FIG. 15. This organic EL display device is similar to the organic EL display device of the third embodiment shown in FIG. 11 except for the configuration for causing the influence due to potential fluctuation of the adjacent signal lines 12 to be uniform, and using a common voltage generator for the colors. In the third embodiment, the case in which luminescent materials having substantially the same gamma characteristics are used for R and B was described. In the fourth embodiment, the case in which R and G are substantially the same will be described. Therefore, similar parts in FIG. 15 are denoted by the same reference numerals, and description thereof is simplified or omitted. Additionally, a plurality of pixels PX are arrayed in the order of red, blue, and green in the row direction.

Concretely, the gradation reference voltage group is used in common for those colors (e.g., red and green) of the luminescent material that have substantially the same gamma characteristics, and the gradation voltage group for blue is independent. Moreover, one color-display pixel is formed of red, blue, and green pixels arrayed in this order. The blue pixel is disposed at the center of the color-display pixel. That is, the signal line connected to the blue pixel is disposed between the adjacent signal lines connected to the red and green pixels in the color-display pixel. As shown in FIG. 15, the reference voltage generating section 20 includes a voltage generator 20RG which generates a gradation reference voltage group for red and green and a voltage generator 20B which generates a gradation reference voltage group for blue. The voltage generator 20RG is a voltage dividing circuit for dividing the power source voltage for red and green supplied between reference power terminals VRGL and VRGH by means of resistors to generate the gradation reference voltage group for red and green, that is, m reference voltages VRG1 to VRGm. The voltage generator 20B is a voltage dividing circuit for dividing the power source voltage for blue supplied between reference power terminals VBL and VBH by means of resistors to generate the gradation reference voltage group for blue, that is, m reference voltages VB1 to VBm. Here, the reference voltages of the gradation reference voltage groups for red and green and for blue are properly determined to perform gamma correction to eliminate distortion of white balance and gradation between the organic EL elements 16.

Furthermore, the reference voltage group changing circuit 23A includes two switch groups SS1, SS2 assigned to each of the signal line blocks. Each of the switch groups SS1, SS2 includes m switches for selecting the reference voltages VRG1 to VRGm when the changing control signal VCONT1 is at high level, and m switches for selecting the reference voltages VB1 to VBm when the changing control signal VCONT2 is at high level, and supplies the gradation reference voltage groups for red and green and for blue to the conversion circuits 24 assigned to the signal line blocks.

The signal line changing circuit 23B includes the switch groups DD1, DD2, . . . assigned to the signal line blocks. The switch groups DD1, DD3, DD5, . . . are assigned to the odd-numbered signal line blocks. Each switch group includes a switch for selecting the signal line 12 for the red pixel with respect to the output circuit 25 when the changing control signal ASW1 is at high level, a switch for selecting the signal line 12 for the blue pixel with respect to the output circuit 25 when the changing control signal ASW2 is at high level, and a switch for selecting the signal line 12 for the green pixel with respect to the output circuit 25 when the changing control signal ASW3 is at high level. The switch groups DD2, DD4, DD6, . . . are assigned to the even-numbered signal line blocks. Each switch group includes a switch for selecting the signal line 12 for the green pixel with respect to the output circuit 25 when the changing control signal ASW1 is at high level, a switch for selecting the signal line 12 for the blue pixel with respect to the output circuit 25 when the changing control signal ASW2 is at high level, and a switch for selecting the signal line 12 for the red pixel with respect to the output circuit 25 when the changing control signal ASW3 is at high level. Each of the switch groups DD1, DD2, . . . supplies the analog video signal for red from the output circuit 25 to the signal line 12 for the red pixel, supplies the analog video signal for blue from the output circuit 25 to the signal line 12 for the blue pixel, and further supplies the analog video signal for green from the output circuit 25 to the signal line 12 for the green pixel. That is, the order of changing the signal lines 12 for the red, blue, and green pixels is reversed between the switch groups DD1, DD3, DD5, . . . and the switch groups DD2, DD4, DD6, . . . .

Figure 16:
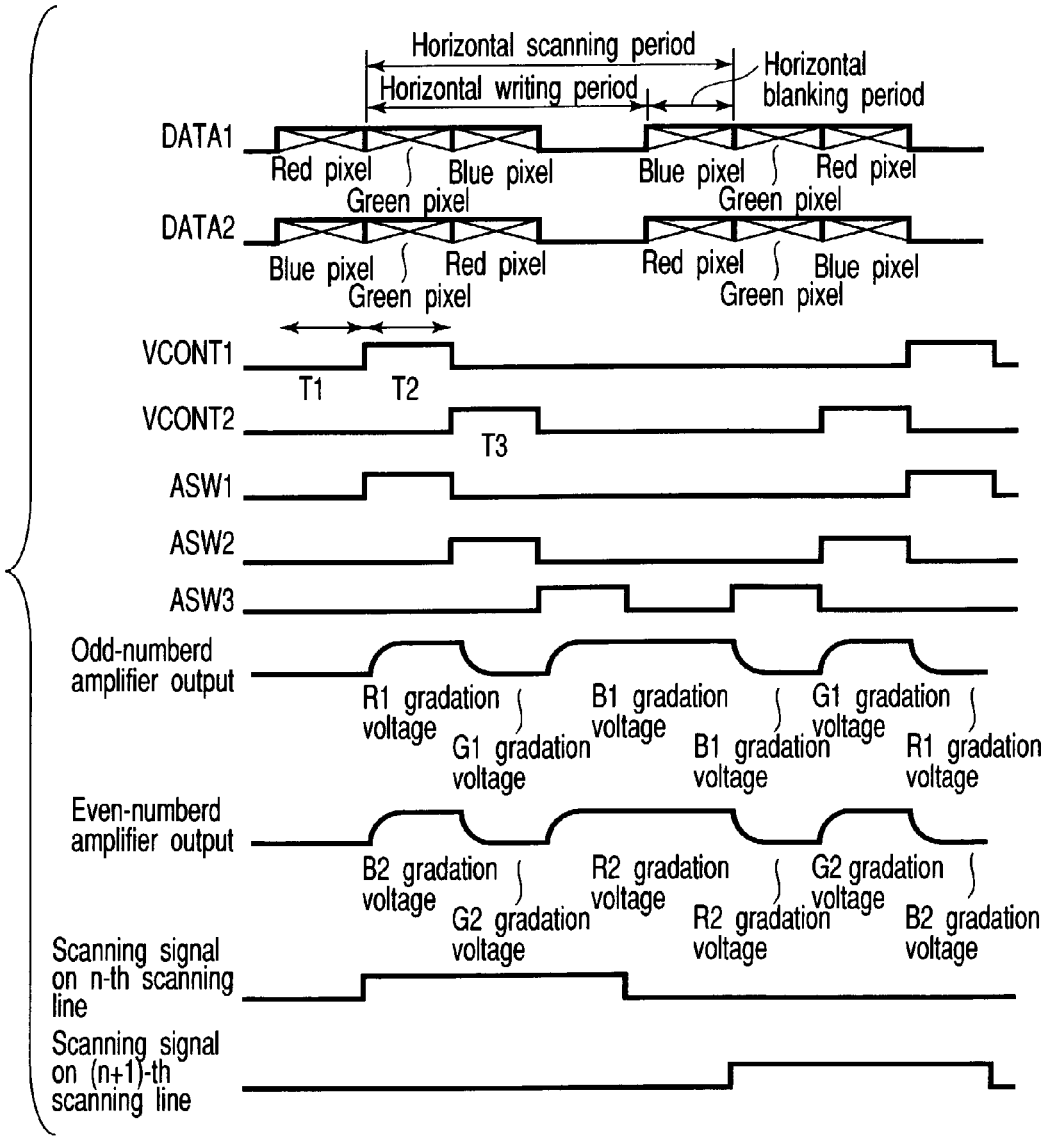
FIG. 16 is a timing chart showing the operation of the signal line driver shown in FIG. 15.

FIG. 16 shows the operation of the organic EL display device. In the organic EL display device, the gradation data DATA1, DATA2, . . . for the red, blue, and green pixels is supplied as digital video signals for the signal line blocks every horizontal scanning period. Concretely, the gradation data DATA1 for the red, blue, and green pixels is supplied to the odd-numbered signal line block in the periods T1, T2, and T3, respectively. Moreover, parallel to this, the gradation data DATA2 for the green, blue, and red pixels is supplied to the even-numbered signal line block in the periods T1, T2, and T3, respectively.

In each odd-numbered stage of the conversion circuit 24, the latch circuit 24B latches the gradation data DATA1 for the red pixel in the period T1, and supplies the data to the DAC module of the odd-numbered stage in response to the load signal LOAD in the period T2. In the period T2, the changing control signals VCONT1 and ASW1 are kept at high level. Thereby, the DAC module refers to the gradation reference voltage group VRG1 to VRGm from the voltage generator 20RG to convert the gradation data DATA1 for red to an analog gradation voltage, and supplies the voltage to the output circuit 25. The gradation voltage is amplified in the output circuit 25, and supplied as an analog video signal to the signal line 12 for the red pixel in the corresponding signal line block. Furthermore, the latch circuit 24B latches the gradation data DATA1 for the blue pixel in the period T2, and supplies the data to the DAC module in response to the load signal LOAD in the period T3. The changing control signals VCONT2 and ASW2 are kept at high level in the period T3. Thereby, the DAC module refers to the gradation reference voltage group VB1 to VBm from the voltage generator 20B to convert the gradation data DATA1 for the blue pixel to an analog gradation voltage, and supplies the voltage to the output circuit 25. The gradation voltage is amplified by the output circuit 25 and supplied as an analog video signal to the signal line 12 for the blue pixel in the corresponding signal line block. Further, the latch circuit 24B latches the gradation data DATA1 for the green pixel in the period T3, and supplies the data to the DAC module in response to the load signal LOAD in the period T4. The changing control signals VCONT1 and ASW3 are kept at high level in the period T4. Thereby, the DAC module refers to the gradation reference voltage group VRG1 to VRGm from the voltage generator 20RG to convert the gradation data DATA1 for the green pixel to an analog gradation voltage, and supplies the voltage to the output circuit 25. The gradation voltage is amplified by the output circuit 25 and supplied as an analog video signal to the signal line 12 for the green pixel in the corresponding signal line block.

On the other hand, in each even-numbered stage of the conversion circuit 24, the latch circuit 24B latches the gradation data DATA2 for the green pixel in the period T1, and supplies the data to the DAC module in response to the load signal LOAD in the period T2. In the period T2, the changing control signals VCONT1 and ASW1 are kept at high level. Thereby, the DAC module refers to the gradation reference voltage group VRG1 to VRGm from the voltage generator 20RG to convert the gradation data DATA2 for the green pixel to an analog gradation voltage, and supplies the voltage to the output circuit 25. The gradation voltage is amplified by the output circuit 25, and supplied as an analog video signal to the signal line 12 for the green pixel in the corresponding signal line block. Furthermore, the latch circuit 24B latches the gradation data DATA2 for the blue pixel in the period T2, and supplies the data to the DAC module in response to the load signal LOAD in the period T3. The changing control signals VCONT2 and ASW2 are kept at high level in the period T3. Thereby, the DAC module refers to the gradation reference voltage groups VB1 to VBm from the voltage generator 20B to convert the gradation data DATA2 for blue to an analog gradation voltage, and supplies the voltage to the output circuit 25. The gradation voltage is amplified by the output circuit, and supplied as an analog video signal to the signal line 12 for the blue pixel in the corresponding signal line block. Further, the latch circuit 24B latches the gradation data DATA2 for the red pixel in the period T3, and supplies the data to the DAC module in response to the load signal LOAD in the period T4. The changing control signals VCONT1 and ASW3 are kept at high level in the period T4. Thereby, the DAC module refers to the gradation reference voltage group VRG1 to VRGm from the voltage generator 20RG to convert the gradation data DATA2 for the red pixel to an analog gradation voltage, and supplies the voltage to the output circuit 25. The gradation voltage is amplified by the output circuit 25, and supplied as an analog video signal to the signal line 12 for the red pixel in the corresponding signal line block.

When the plurality of signal lines 12 are driven in one horizontal scanning period as described above, the selection orders of the gradation data, gradation reference voltage groups, and signal lines are reversed in the next horizontal scanning period. The above-described operation is repeated to display an image. Furthermore, also for the next frame period (vertical scanning period), the selection orders of the gradation data, gradation reference voltage groups, and signal lines are reversed for each horizontal scanning period. Thereby, the plurality of signal lines 12 are driven in an order that ensures the potential fluctuation is reduced as shown in (c)-1 of FIG. 8A. In addition, the rising timings of the changing control signals VCONT1 and ASW1, VCONT2 and ASW2, and VCONT3 and ASW3 may be determined such that the signal lines 12 are driven in the order shown in one of (b)-1 to (c)-2 of FIGS. 8A and 8B. Furthermore, the driving order may be changed for each frame as shown in one of (d) and (e) of FIG. 8B. Additionally, connections of the signal line changing circuit 23B may be changed so as to obtain the driving order shown in (a) of FIG. 8A.

In the organic EL display device of the fifth embodiment, the order of driving the signal lines 12 for each horizontal scanning period is optimized to reduce the number of potential changes in each signal line 12 in an electrically floating state. Further, since the order of driving the signal lines 12 is changed in at least one of the predetermined vertical and horizontal scanning periods, the pixels whose gradation voltages fluctuate can be dispersed in time or space. Furthermore, in the reference voltage generating section 20, since the gradation reference voltage group generated by the voltage generator 20RG is used in common for the digital-to-analog conversion of the gradation data for red and green, the scale of the signal line driver 15 can be further reduced.

Figure 17:
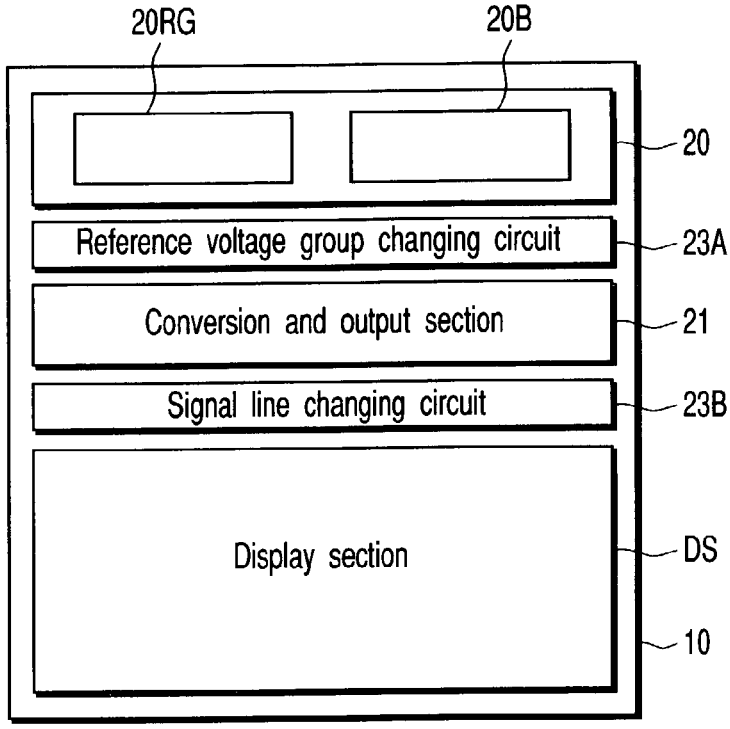
FIG. 17 is a diagram showing a display panel including a reference voltage generating section, reference voltage group changing circuit, conversion and output section, signal line changing circuit, and display section in the fifth embodiment shown in FIG. 15.
Figure 18:
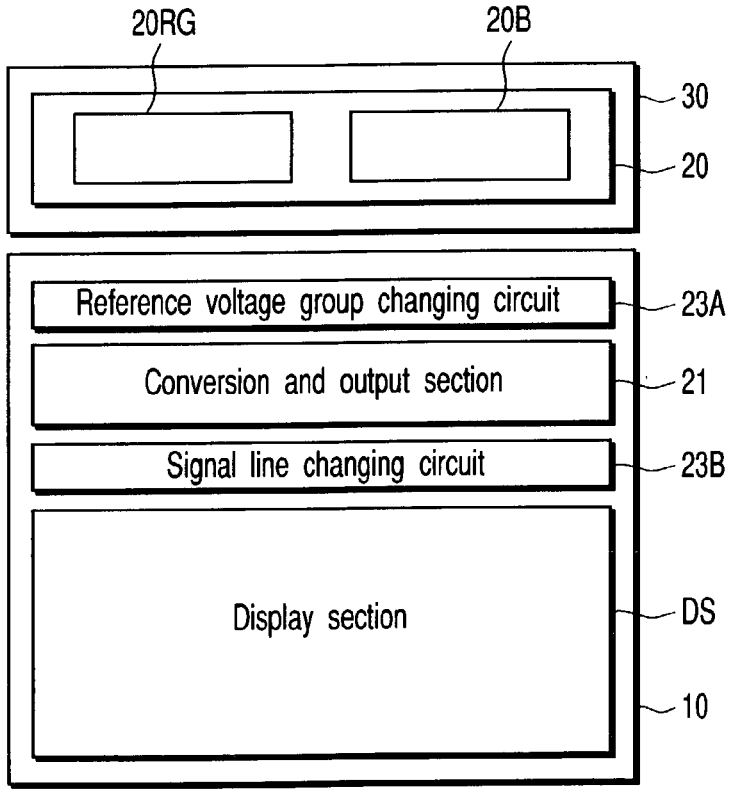
FIG. 18 is a diagram showing a driving circuit board including the reference voltage generating section shown in FIG. 17, together with a display panel including the reference voltage group changing circuit, conversion and output section, signal line changing circuit, and display section.
Figure 19:
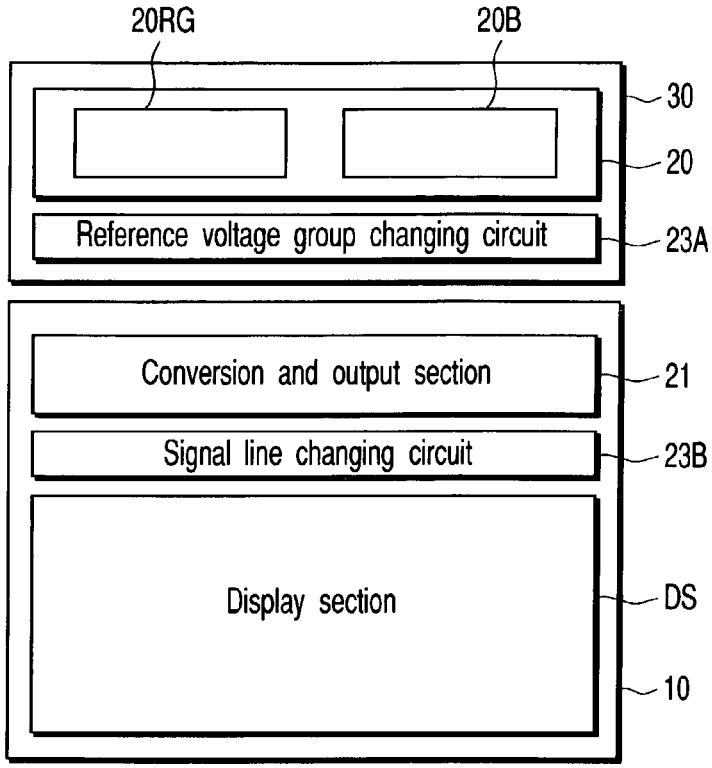
FIG. 19 is a diagram showing a driving circuit board including the reference voltage generating section and reference voltage group changing circuit shown in FIG. 17, together with a display panel including the conversion and output section and signal line changing circuit.
Figure 20:
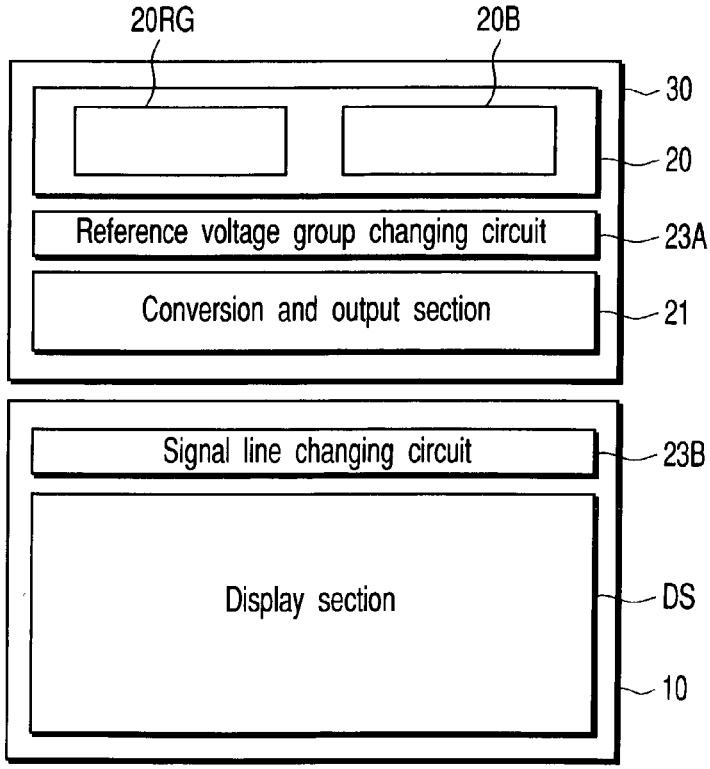
FIG. 20 is a diagram showing a driving circuit board including the reference voltage generating section, reference voltage group changing circuit, and conversion and output section shown in FIG. 17, together with a display panel including the signal line changing circuit.

Additionally, in the present embodiment, as shown in FIG. 17, the reference voltage generating section 20, reference voltage group changing circuit 23A, conversion and output section 21, and signal line changing circuit 23B are disposed together with the display section DS on the display panel 10. However, as shown in FIG. 18, the reference voltage generating section 20 may be disposed on the driving circuit board 30 which is independent of the display panel 10. Moreover, the reference voltage group changing circuit 23A may be disposed together with the reference voltage generating section 20 on the driving circuit board 30 as shown in FIG. 19. Furthermore, the conversion and output section 21 may be disposed together with the reference voltage generating section 20 and reference voltage group changing circuit 23A on the driving circuit board 30 as shown in FIG. 20.

Additionally, in the present embodiment, the signal line changing circuit 23B is configured to simultaneously select the signal lines for the red, green, or blue pixels in each sub-array. Generally, the gate of the driving element 17 in each display pixel PX is caused to float electrically when the pixel switch 13 is turned off. Therefore, the gate is easily influenced by potential fluctuation of the adjacent signal line 12 because of capacitive coupling to the gate wiring. In the case where the signal lines 12 for the red, green, and blue pixels are driven for each horizontal scanning period in the order shown in (a) of FIG. 8A, the original gradation voltage cannot be maintained since the potentials of the signal lines 12 excluding the outermost two of the signal lines 12 fluctuate in the following manner. Every horizontal scanning period, the potential of each signal line for the red pixel fluctuates twice, that of each signal line for the blue pixel fluctuates once, and that of each signal line for the green pixel does not fluctuate. That is, when the signal lines 12 are driven in the aforementioned order, the potentials of the plurality of signal lines 12 easily and non-uniformly fluctuate because of video signals in the adjacent signal lines. In order to reduce the whole potential fluctuation, it is preferable that the signal lines 12 are driven in the order shown in one of (b)-1 to (e) of FIGS. 8A and 8B, for example. In the above-described embodiment, the plurality of signal lines 12 are driven in an order that ensures the potential fluctuation is reduced as shown in (e) of FIG. 8B. For example, even when the driving order is not reversed for each one of the vertical and horizontal scanning periods as shown in (b)-1 or (b)-2 of FIG. 8A, the pixel influenced by the potential fluctuation twice can be eliminated.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A display device comprising:

a plurality of signal lines disposed on a substrate;

a plurality of scanning lines intersecting said signal lines substantially at right angles;

a plurality of pixel switches disposed near intersections of said signal lines and scanning lines;

a plurality of display pixels selectable by said pixel switches; and a signal line driving circuit which supplies analog video signals to the signal lines;

wherein each of said display pixels includes one of two or more electroluminescent elements different from each other in a dominant wavelength of light emitted therefrom, the different electroluminescent elements are arrayed in a scanning line direction, and said signal line driving circuit comprises:

a selector circuit which selectively outputs one of gradation reference voltage groups corresponding to the different electroluminescent elements;

a conversion circuit including a plurality of digital-to-analog converters which are arranged such that the signal lines are divided into a plurality of signal line blocks each having a predetermined number of signal lines, convert a digital signal externally input for each signal line block into an analog signal based on the gradation reference voltage group selectively output from said selector circuit to set an individual color intensity level for at least one of the electroluminescent elements, and serially output the analog signal as the analog video signal; and a signal line selection circuit which sequentially distributes the analog video signal from said conversion circuit to related signal lines of the signal line block.

2. A display device according to claim 1, wherein said display pixel comprises one of three-display elements different from each other in the dominant wavelength of the light emitted therefrom.

3. A display device according to claim 2, wherein said predetermined number corresponds to an integral multiple of 3.

4. A display device according to claim 2, wherein said signal line driving circuit includes at least first and second voltage generators which generate gradation reference voltage groups different from each other.

5. A display device according to claim 4, wherein a first display pixel including a first display element independently occupies one of said voltage generators, and is located between the display pixels including display elements different from the first display element.

6. A display device according to claim 4, wherein a first display pixel including a first display element independently occupies one of said voltage generators, three of said signal lines are assigned to three display pixels including the first display pixel, and the one signal line for the first display pixel is located between the signal lines for the display pixels including display elements different from the first display element.

7. A display device according to claim 4, wherein said selector circuit includes a changing circuit which connects said first voltage generator to the digital-to-analog converters assigned to even-numbered signal line blocks and which connects said second voltage generator to the digital-to-analog converters assigned to odd-numbered signal line blocks.

8. A display device according to claim 4, wherein said selector circuit is configured to connect one of said first and second voltage generators to each of the digital-to-analog converters assigned to the signal line blocks.

9. A display device according to claim 2, wherein said signal line driving circuit includes three reference voltage generators which generates a different gradation reference voltage group for red, green, and blue pixels.

10. A display device according to claim 1, wherein said signal line selection circuit is disposed on said substrate.

11. A display device according to claim 10, wherein said digital-to-analog converter is further disposed on said substrate.

12. A display device according to claim 4, wherein said changing circuit is further disposed on said substrate.

13. A display device according to claim 12, wherein said voltage generator is further disposed on said substrate.

14. A display device according to claim 1, wherein said signal line selection circuit is configured to select signal lines of adjacent signal line blocks to which said analog video signals are simultaneously supplied in an initial selection period of each horizontal scanning period, and sequentially change the selection of signal lines of the adjacent signal line blocks in selection periods subsequent to said initial selection period.

15. A display device according to claim 14, wherein a signal line selection order of said signal line selection circuit is reversed every predetermined horizontal scanning period.

16. A display device according to claim 14, wherein a signal line selection order of said signal line selection circuit is reversed every vertical scanning period.

17. A display device according to claim 13, wherein a signal line selection order of said signal line selection circuit is reversed every horizontal scanning period, and further reversed every vertical scanning period.

* * * * *